US008360851B2

(12) United States Patent
Aoki et al.

(10) Patent No.: US 8,360,851 B2
(45) Date of Patent: Jan. 29, 2013

(54) WAGERING GAME WITH PROGRESSIVE GAME AWARD VALUES ASSOCIATED WITH REEL SYMBOLS

(75) Inventors: Dion K. Aoki, Henderson, NV (US); Andrew Guinn, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 13/274,104

(22) Filed: Oct. 14, 2011

(65) Prior Publication Data

US 2012/0094738 A1 Apr. 19, 2012

Related U.S. Application Data

(60) Provisional application No. 61/393,738, filed on Oct. 15, 2010.

(51) Int. Cl.
*A63F 9/24* (2006.01)

(52) U.S. Cl. ..... 463/20; 463/27

(58) Field of Classification Search ..... 463/20, 463/27

See application file for complete search history.

(56) References Cited

U.S. PATENT DOCUMENTS

| | | | | |
|---|---|---|---|---|
| 4,624,459 | A | 11/1986 | Kaufman | 273/143 R |
| 4,837,728 | A | 6/1989 | Barrie et al. | 364/412 |
| 4,861,041 | A | 8/1989 | Jones et al. | 273/292 |
| 4,948,134 | A | 8/1990 | Suttle et al. | 273/85 |
| 5,116,055 | A | 5/1992 | Tracy | 273/138 A |
| 5,249,800 | A | 10/1993 | Hilgendorf et al. | 273/138 A |
| 5,275,400 | A | 1/1994 | Weingardt et al. | 463/12 |
| 5,280,909 | A | 1/1994 | Tracy | 273/138 A |
| 5,344,144 | A | 9/1994 | Canon | 273/138 A |
| 5,377,973 | A | 1/1995 | Jones et al. | 273/85 CP |
| 5,393,057 | A | 2/1995 | Marnell, II | 273/85 CP |
| 5,417,430 | A | 5/1995 | Breeding | 273/292 |
| 5,524,888 | A | 6/1996 | Heidel | 463/22 |
| 5,544,892 | A | 8/1996 | Breeding | 273/292 |
| 5,564,700 | A | 10/1996 | Celona | 463/27 |

(Continued)

FOREIGN PATENT DOCUMENTS

| | | |
|---|---|---|
| CA | 2 334 546 | 8/2001 |
| DE | 195 15 983 A1 | 11/1996 |

(Continued)

OTHER PUBLICATIONS

Article for "Easy Riches" by Sigma Game, Strictly Slots, 1 page (Aug. 2001).

(Continued)

*Primary Examiner* — Dmitry Suhol
*Assistant Examiner* — Jay Trent Liddle
(74) *Attorney, Agent, or Firm* — Nixon Peabody LLP

(57) ABSTRACT

A gaming terminal plays a wagering game having a plurality of reels with symbols including progressive-game symbols. The wagering game provides access to a progressive game having progressive game awards indicated by the progressive-game symbols. The gaming terminal comprises a wager input device, a display, and at least one controller. The wager input device receives a wager input for playing the wagering game. The display is for displaying the plurality of reels with the progressive-game symbols. Each of the progressive-game symbols is displayed with an associated individual value. The controller is coupled to the display and operative to cause the display to display the incrementing of the individual values of the progressive-game symbols based on game play activity. The controller is also operative to provide a progressive game award based on the individual values of the progressive-game symbols on the plurality of reels that triggered the progressive game award.

46 Claims, 10 Drawing Sheets

U.S. PATENT DOCUMENTS

| | | | | |
|---|---|---|---|---|
| 5,577,959 | A | 11/1996 | Takemoto | 463/25 |
| 5,580,063 | A | 12/1996 | Edwards | 273/378 |
| 5,580,309 | A | 12/1996 | Piechowiak et al. | 463/16 |
| 5,611,730 | A | 3/1997 | Weiss | 463/20 |
| 5,645,486 | A | 7/1997 | Nagao et al. | 463/27 |
| 5,647,592 | A | 7/1997 | Gerow | 463/139 |
| 5,655,961 | A | 8/1997 | Acres et al. | 463/27 |
| 5,766,076 | A | 6/1998 | Pease et al. | 463/27 |
| RE35,864 | E | 7/1998 | Weingardt | 463/28 |
| 5,779,549 | A | 7/1998 | Walker et al. | 463/42 |
| 5,816,918 | A | 10/1998 | Kelly et al. | 463/16 |
| 5,820,459 | A | 10/1998 | Acres et al. | 463/25 |
| 5,823,874 | A | 10/1998 | Adams | 463/17 |
| 5,839,956 | A | 11/1998 | Takemoto | 463/25 |
| 5,848,932 | A | 12/1998 | Adams | 463/20 |
| 5,851,147 | A | 12/1998 | Stupak | 463/13 |
| 5,855,515 | A | 1/1999 | Pease et al. | 463/27 |
| 5,876,284 | A | 3/1999 | Acres et al. | 463/25 |
| 5,885,158 | A | 3/1999 | Torango et al. | 463/27 |
| 5,941,773 | A | 8/1999 | Harlick | 463/26 |
| 5,944,606 | A | 8/1999 | Gerow | 463/27 |
| 5,951,011 | A | 9/1999 | Potter et al. | 273/292 |
| 6,003,013 | A | 12/1999 | Boushy et al. | 705/10 |
| 6,007,427 | A | 12/1999 | Wiener et al. | 463/17 |
| 6,012,982 | A | 1/2000 | Piechowiak et al. | 463/16 |
| 6,032,955 | A | 3/2000 | Luciano et al. | 273/138.1 |
| 6,047,963 | A | 4/2000 | Pierce et al. | 273/121 B |
| 6,089,977 | A | 7/2000 | Bennett | 463/20 |
| 6,089,980 | A | 7/2000 | Gauselmann | 463/27 |
| 6,102,474 | A | 8/2000 | Daley | 296/836 |
| 6,102,799 | A | 8/2000 | Stupak | 463/27 |
| 6,110,043 | A | 8/2000 | Olsen | 463/27 |
| 6,139,013 | A | 10/2000 | Pierce et al. | 273/121 B |
| 6,142,872 | A | 11/2000 | Walker et al. | 463/16 |
| 6,146,273 | A | 11/2000 | Olsen | 463/27 |
| 6,155,925 | A | 12/2000 | Giobbi et al. | 463/20 |
| 6,158,741 | A | 12/2000 | Koelling | 273/292 |
| 6,159,097 | A | 12/2000 | Gura | 463/20 |
| 6,168,523 | B1 | 1/2001 | Piechowiak et al. | 463/26 |
| 6,203,010 | B1 | 3/2001 | Jorasch et al. | 273/138.1 |
| 6,206,374 | B1 | 3/2001 | Jones | 273/292 |
| 6,206,782 | B1 | 3/2001 | Walker et al. | 463/25 |
| 6,210,275 | B1 | 4/2001 | Olsen | 463/16 |
| 6,210,277 | B1 | 4/2001 | Stefan | 463/27 |
| 6,217,448 | B1 | 4/2001 | Olsen | 463/25 |
| 6,220,593 | B1 | 4/2001 | Pierce et al. | 273/138.1 |
| 6,224,482 | B1 | 5/2001 | Bennett | 463/20 |
| 6,224,484 | B1 | 5/2001 | Okuda et al. | 463/27 |
| 6,231,445 | B1 | 5/2001 | Acres | 463/42 |
| 6,241,608 | B1 | 6/2001 | Torango | 463/27 |
| 6,254,483 | B1 | 7/2001 | Acres | 463/26 |
| 6,312,332 | B1 | 11/2001 | Walker et al. | 463/23 |
| 6,315,660 | B1 | 11/2001 | DeMar et al. | 463/16 |
| 6,319,125 | B1 | 11/2001 | Acres | 463/25 |
| 6,319,127 | B1 | 11/2001 | Walker et al. | 463/26 |
| 6,336,859 | B2 | 1/2002 | Jones et al. | 463/13 |
| 6,336,862 | B1 | 1/2002 | Byrne | 463/27 |
| 6,345,824 | B1 | 2/2002 | Selitzky | 273/292 |
| 6,347,996 | B1 | 2/2002 | Gilmore et al. | 463/17 |
| 6,358,149 | B1 | 3/2002 | Schneider et al. | 463/27 |
| 6,361,441 | B1 | 3/2002 | Walker et al. | 463/42 |
| 6,364,768 | B1 | 4/2002 | Acres et al. | 463/25 |
| 6,375,567 | B1 | 4/2002 | Acres | 463/25 |
| 6,375,568 | B1 | 4/2002 | Roffman et al. | 463/26 |
| 6,416,409 | B1 | 7/2002 | Jordan | 463/27 |
| 6,431,983 | B2 | 8/2002 | Acres | 463/25 |
| 6,435,968 | B1 | 8/2002 | Torango | 463/27 |
| 6,439,995 | B1 | 8/2002 | Hughs-Baird et al. | 463/20 |
| 6,482,089 | B2 | 11/2002 | DeMar et al. | 463/20 |
| 6,506,117 | B2 | 1/2003 | DeMar et al. | 463/20 |
| 6,508,707 | B2 | 1/2003 | DeMar et al. | 463/16 |
| 6,517,433 | B2 | 2/2003 | Loose et al. | 463/20 |
| 6,520,855 | B2 | 2/2003 | DeMar et al. | 463/20 |
| 6,577,733 | B1 | 6/2003 | Charrin | 380/251 |
| 6,589,115 | B2 | 7/2003 | Walker et al. | 463/25 |
| 6,592,458 | B1 | 7/2003 | Ho | 463/17 |
| 6,592,460 | B2 | 7/2003 | Torango | 463/27 |
| 6,599,186 | B1 | 7/2003 | Walker et al. | 463/17 |
| 6,599,188 | B2 | 7/2003 | Hirsch et al. | 463/19 |
| 6,599,193 | B2 | 7/2003 | Baerlocher et al. | 463/27 |
| 6,601,771 | B2 | 8/2003 | Charrin | 235/492 |
| 6,648,762 | B2 | 11/2003 | Walker et al. | 463/25 |
| 6,656,052 | B2 | 12/2003 | Abramopoulos et al. | 463/47 |
| 6,676,513 | B2 | 1/2004 | Gauselmann | 463/20 |
| 6,712,695 | B2 | 3/2004 | Mothwurf et al. | 463/25 |
| 6,733,390 | B2 | 5/2004 | Walker et al. | 463/23 |
| 6,776,715 | B2 | 8/2004 | Price | 463/27 |
| 6,887,154 | B1 | 5/2005 | Luciano, Jr. et al. | 463/26 |
| 7,004,466 | B2 | 2/2006 | Gauselmann | 463/138 |
| 7,036,012 | B2 | 4/2006 | Charrin | 713/169 |
| 7,056,215 | B1 | 6/2006 | Olive | 463/27 |
| 7,481,430 | B1 * | 1/2009 | Jackson et al. | 273/138.1 |
| 7,601,060 | B2 * | 10/2009 | Baerlocher et al. | 463/20 |
| 7,780,520 | B2 * | 8/2010 | Baerlocher | 463/25 |
| 8,137,180 | B2 * | 3/2012 | Thomas et al. | 463/20 |
| 2002/0138594 | A1 | 9/2002 | Rowe | 709/219 |
| 2002/0151345 | A1 | 10/2002 | Byrne | 463/18 |
| 2002/0155874 | A1 | 10/2002 | Byrne | 463/16 |
| 2003/0014370 | A1 | 1/2003 | Charrin | 705/65 |
| 2003/0027618 | A1 | 2/2003 | Byrne | 463/16 |
| 2003/0027625 | A1 | 2/2003 | Rowe | 463/20 |
| 2003/0036430 | A1 | 2/2003 | Cannon | 463/42 |
| 2003/0045337 | A1 | 3/2003 | Byrne | 463/16 |
| 2003/0045351 | A1 | 3/2003 | Gauselmann | 463/29 |
| 2003/0050106 | A1 | 3/2003 | Lyfoung | 463/13 |
| 2003/0060266 | A1 | 3/2003 | Baerlocher | 463/20 |
| 2003/0064776 | A1 | 4/2003 | Byrne | 463/16 |
| 2003/0109306 | A1 | 6/2003 | Karmarkar | 463/40 |
| 2003/0148807 | A1 | 8/2003 | Acres | 463/40 |
| 2003/0148808 | A1 | 8/2003 | Price | 463/27 |
| 2003/0181231 | A1 | 9/2003 | Vancura et al. | 463/9 |
| 2003/0186733 | A1 | 10/2003 | Wolf et al. | 463/16 |
| 2003/0211884 | A1 | 11/2003 | Gauselmann | 463/20 |
| 2003/0216166 | A1 | 11/2003 | Baerlocher et al. | 463/20 |
| 2003/0222402 | A1 | 12/2003 | Olive | 273/292 |
| 2003/0228899 | A1 | 12/2003 | Evans | 463/25 |
| 2003/0236116 | A1 | 12/2003 | Marks et al. | 463/16 |
| 2004/0009808 | A1 | 1/2004 | Gauselmann | 463/25 |
| 2004/0009811 | A1 | 1/2004 | Torango | 463/25 |
| 2004/0023716 | A1 | 2/2004 | Gauselmann | 463/23 |
| 2004/0038741 | A1 | 2/2004 | Gauselmann | 463/42 |
| 2004/0048644 | A1 | 3/2004 | Gerrard et al. | 463/16 |
| 2004/0092304 | A1 | 5/2004 | George | 463/29 |
| 2005/0003880 | A1 | 1/2005 | Engleman | 463/16 |
| 2005/0055113 | A1 | 3/2005 | Gauselmann | 700/91 |
| 2005/0059467 | A1 | 3/2005 | Saffari et al. | 463/19 |
| 2005/0059472 | A1 | 3/2005 | Joshi et al. | 463/20 |
| 2005/0064930 | A1 | 3/2005 | Jubinville et al. | 463/17 |
| 2005/0096130 | A1 | 5/2005 | Mullins | 463/27 |
| 2005/0137010 | A1 | 6/2005 | Enzminger et al. | 463/25 |
| 2005/0192088 | A1 | 9/2005 | Hartman et al. | 463/27 |
| 2005/0215313 | A1 | 9/2005 | O'Halloran | 463/26 |
| 2006/0003829 | A1 | 1/2006 | Thomas | 463/20 |
| 2006/0019737 | A1 | 1/2006 | Yang | 463/19 |
| 2006/0025195 | A1 | 2/2006 | Pennington et al. | 463/16 |
| 2006/0025210 | A1 | 2/2006 | Johnson | 463/25 |
| 2006/0030403 | A1 | 2/2006 | Lafky et al. | 463/27 |
| 2006/0035706 | A1 * | 2/2006 | Thomas et al. | 463/27 |
| 2006/0040736 | A1 * | 2/2006 | Baerlocher et al. | 463/27 |
| 2006/0052159 | A1 | 3/2006 | Cahill et al. | 463/27 |
| 2006/0073887 | A1 | 4/2006 | Nguyen et al. | 463/20 |
| 2006/0073889 | A1 | 4/2006 | Edidin et al. | 463/27 |
| 2006/0116201 | A1 | 6/2006 | Gausselmann | 463/26 |
| 2006/0142079 | A1 | 6/2006 | Ikehara et al. | 463/27 |
| 2006/0142086 | A1 | 6/2006 | Blackburn et al. | 463/42 |
| 2006/0154718 | A1 | 7/2006 | Willyard et al. | 463/25 |
| 2006/0178203 | A1 | 8/2006 | Hughes et al. | 463/20 |
| 2006/0183535 | A1 | 8/2006 | Marks et al. | 463/20 |
| 2006/0183537 | A1 | 8/2006 | Dickerson | 463/27 |
| 2006/0183538 | A1 | 8/2006 | Michaelson et al. | 463/27 |
| 2006/0189380 | A1 | 8/2006 | Schultz et al. | 463/20 |
| 2006/0281527 | A1 | 12/2006 | Dunaevsky et al. | 463/20 |
| 2006/0287077 | A1 | 12/2006 | Grav et al. | 463/27 |
| 2007/0026941 | A1 | 2/2007 | Block et al. | 463/29 |
| 2007/0054733 | A1 | 3/2007 | Baerlocher | 463/27 |
| 2007/0060244 | A1 | 3/2007 | Yaldoo et al. | 463/16 |
| 2007/0060271 | A1 | 3/2007 | Cregan et al. | 463/16 |

| | | | | |
|---|---|---|---|---|
| 2007/0060314 | A1 | 3/2007 | Baerlocher et al. | 463/25 |
| 2007/0060319 | A1 | 3/2007 | Block et al. | 463/27 |
| 2007/0060365 | A1 | 3/2007 | Tien et al. | 463/42 |
| 2009/0042643 | A1* | 2/2009 | Gagner et al. | 463/27 |
| 2009/0048012 | A1* | 2/2009 | Patel et al. | 463/20 |
| 2009/0131149 | A1 | 5/2009 | Jackson et al. | 463/20 |
| 2009/0131160 | A1* | 5/2009 | Torres | 463/27 |
| 2009/0298574 | A1 | 12/2009 | Gauselmann | 463/20 |
| 2009/0305777 | A1 | 12/2009 | Anderson | 463/27 |
| 2010/0048284 | A1* | 2/2010 | Jaffe | 463/20 |
| 2010/0113131 | A1* | 5/2010 | Aoki et al. | 463/20 |
| 2010/0227677 | A1* | 9/2010 | Baerlocher | 463/27 |
| 2010/0304830 | A1 | 12/2010 | Englman et al. | 463/17 |
| 2011/0111845 | A1* | 5/2011 | Fitzsimons et al. | 463/27 |

FOREIGN PATENT DOCUMENTS

| | | | |
|---|---|---|---|
| DE | 196 24 321 | A1 | 1/1998 |
| EP | 0 521 599 | A1 | 1/1993 |
| GB | 2 153 572 | A | 8/1985 |
| GB | 2 181 589 | A | 4/1987 |
| GB | 2 242 300 | A | 9/1991 |
| GB | 2 313 792 | A | 10/1997 |
| GB | 2 333 880 | A | 8/1999 |
| JP | 2008-212284 | | 9/2008 |
| WO | WO 99/03078 | A1 | 1/1999 |
| WO | WO 99/19037 | A1 | 4/1999 |
| WO | WO 01/33478 | A1 | 5/2001 |
| WO | WO 03/026754 | A1 | 4/2003 |
| WO | WO 03/083789 | A1 | 10/2003 |

OTHER PUBLICATIONS

Article for "Millioniser" by Glenn Haussman, Strictly Slots, pp. 50-53 (Mar. 2004).

Product Sheet for "Big Games Safari," IGT, 24 pages (2000).

"New '97 Games," International Gaming & Wagering Business, 23 pages (Mar. 1997).

Third Party Submission dated Jun. 18, 2012 (2 pages).

* cited by examiner

WAGERING GAME WITH PROGRESSIVE GAME AWARD VALUES ASSOCIATED WITH REEL SYMBOLS

REFERENCE To RELATED APPLICATIONS

This application claims the benefit of U.S. Provisional Patent Application Ser. No. 61/393,738, filed Oct. 15, 2010, and titled "Wagering Game With Progressive Game Award Values Associated With Reel Symbols," which is incorporated herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to a gaming apparatus and methods for playing wagering games, and more particularly to a progressive game in which the progressive game award values are associated with the progressive game symbols on the reels.

BACKGROUND OF THE INVENTION

Gaming terminals, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options.

Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

In order to attract players and achieve player loyalty to different games, game designers seek to make games interesting to the player. There are therefore continual challenges to develop different attractive features to a player in wagering games.

One concept that has been successfully employed to enhance the entertainment value of a game is that of a "secondary" or "bonus" game which may be played in conjunction with a "basic" game. The bonus game may comprise any type of game, either similar to or completely different from the basic game, and is entered upon the occurrence of a selected event or outcome of the basic game. Such a bonus game produces a significantly higher level of player excitement than the basic game because it provides a greater expectation of winning than the basic game.

Another concept that has been employed is the use of a progressive game having one or more progressive jackpots. In the gaming industry, a "progressive" game involves collecting coin-in data (i.e., wager inputs) from participating gaming device(s) (e.g., slot machines), contributing a percentage of that coin-in data to the jackpot amount(s) for the one or more progressive jackpots, and awarding one or more of the progressive jackpot(s) to a player upon the occurrence of certain jackpot-triggering events. A jackpot-triggering event may occur when a "progressive winning position" is achieved at a participating gaming device. If the gaming device is a slot machine, a progressive winning position may, for example, correspond to alignment of progressive jackpot reel symbols along a certain payline. Or, the jackpot-triggering event may be a "mystery" award to a player based on a random number generator that is unrelated to the outcome of the basic game. In any these prior art systems, the player is awarded a progressive jackpot amount that may have increased from its base "reset" value due to wagering inputs for players of the wagering game.

The initial amount of each progressive jackpot is a predetermined minimum amount, usually referred to as a "reset" value. The jackpot amount, however, progressively increases as players continue to play the gaming machine without winning the progressive jackpot. Further, when several gaming machines are linked together such that several players at several gaming machines compete for the same jackpot, the jackpot progressively increases at a much faster rate, which leads to further player excitement. Many players are attracted to wagering games that have progressive jackpots that increase at a rapid rate. In existing progressive jackpots, once the progressive jackpot is triggered, the entire known progressive jackpot is awarded to a first player. The jackpot amount is reset to the predetermined minimum amount, which is a lower amount than the higher jackpot amount that was just triggered by the first player. As such, in these existing games, the player typically has the opportunity to win a single progressive jackpot amount (or progressive jackpot amounts if there is more than one progressive jackpot level).

Thus, what is needed is a wagering system that allows players to remain interested in the wagering game by providing a progressive game that may have several different award amounts, rather than a known, incrementable progressive jackpot amount. Further, what is also needed is a progressive game in which the player can easily visualize the incrementing of the progressive jackpot awards by viewing the symbols on the basic game. These needs are satisfied by the present invention, described in more below, in which the progressive jackpot symbols are assigned individual values that are displayed to the player. The individual values of the progressive jackpot symbols that trigger the award are summed to determine the overall progressive jackpot award value. Because the individual award amounts corresponding to the progressive symbols may be different and different combinations of progressive symbols may trigger a win of the progressive, there are numerous possible amounts for the progressive awards.

SUMMARY

The present invention relates to a method of conducting a wagering game on a gaming system. The wagering game includes a base game and a progressive game having progressive game awards that are indicated by progressive-game symbols. The method comprises receiving, from a wager-input-device, a wager input from a player playing the wagering game, and allocating, by use of at least one controller, a portion of the wager input to the progressive game. The allocated portion is assigned to the progressive-game symbols. The method also includes presenting, on at least one display, the base game with a plurality of moveable reels having symbols thereon, including the progressive-game symbols. Each progressive-game symbol has a displayed individual value that is associated therewith. The method also includes (i) in response to a first triggering condition, awarding a first progressive game award to the player, wherein the first progressive game award is based on the displayed individual values of a first group of progressive-game symbols being displayed on the plurality of moveable reels, and (ii) in response to a second triggering condition, awarding a second progressive game award to the player, wherein the second progressive game award is based on the displayed individual values of a second group of progressive-game symbols being displayed on the plurality of moveable reels. The first progressive game award is different from the second progressive game award.

The present invention also relates to a control module for a gaming system that includes a plurality of gaming terminals for playing wagering games having a plurality of moveable reels. The wagering games provide access to a progressive game having multiple progressive game awards that are indicated by progressive-game symbols. Each of the progressive-game symbols has a base reset value and an individual value that increases from the base reset value in response to wager inputs at the plurality of gaming terminals. Each of the gaming terminals includes a display for displaying the plurality of reels. The gaming-system control module comprises at least one controller that is operative to allocate a portion of a wager input received from a first player at a first gaming terminal to the progressive-game symbols. Each of the progressive-game symbols receives a percentage of the allocated portion of the wager input. The controller is also operative to determine an updated value of each of progressive-game symbols based on the allocated portion of the wager input received from the first player. The controller is also operative to instruct each of the plurality of gaming terminals to display, on their respective displays, the updated values of the progressive-game symbols on the plurality of reels during the wagering game.

The present invention also is a method of conducting a wagering game on a gaming terminal. The wagering game includes a plurality of reels with symbols including progressive-game symbols. The wagering game provides access to a progressive game having progressive awards indicated by the progressive-game symbols. The method comprises receiving, from at least one wager input device on the gaming terminal, wager inputs from a player playing the wagering game. The method also comprises displaying, via the use of at least one display on the gaming terminal, the incrementing of individual values of the progressive-game symbols. The incrementing occurs in response to the game play activity of the wagering game. The method comprises determining, via the use of at least one controller, that the player has achieved a progressive game award while playing the wagering game, and awarding the progressive game award to the player. The overall value of the progressive game award is based on the individual values of the progressive-game symbols that are displayed on the plurality of reels on the display and that triggered the progressive game award.

The present invention also contemplates a gaming terminal for playing a wagering game having a plurality of reels with symbols including progressive-game symbols. The wagering game provides access to a progressive game having progressive game awards that are indicated by the progressive-game symbols. The gaming terminal comprises a wager input device, a display, and at least one controller. The wager input device receives a wager input for playing the wagering game. The display is for displaying the plurality of reels with the progressive-game symbols. Each of the progressive-game symbols is displayed with an associated individual value. The controller is coupled to the display and operative to cause the display to display the incrementing of the individual values of the progressive-game symbols based on game play activity. The controller is also operative to provide a progressive game award based on the individual values of the progressive-game symbols on the plurality of reels that triggered the progressive game award.

Additional aspects of the invention will be apparent to those of ordinary skill in the art in view of the detailed description of various embodiments, which is made with reference to the drawings, a brief description of which is provided below.

Figure 1:
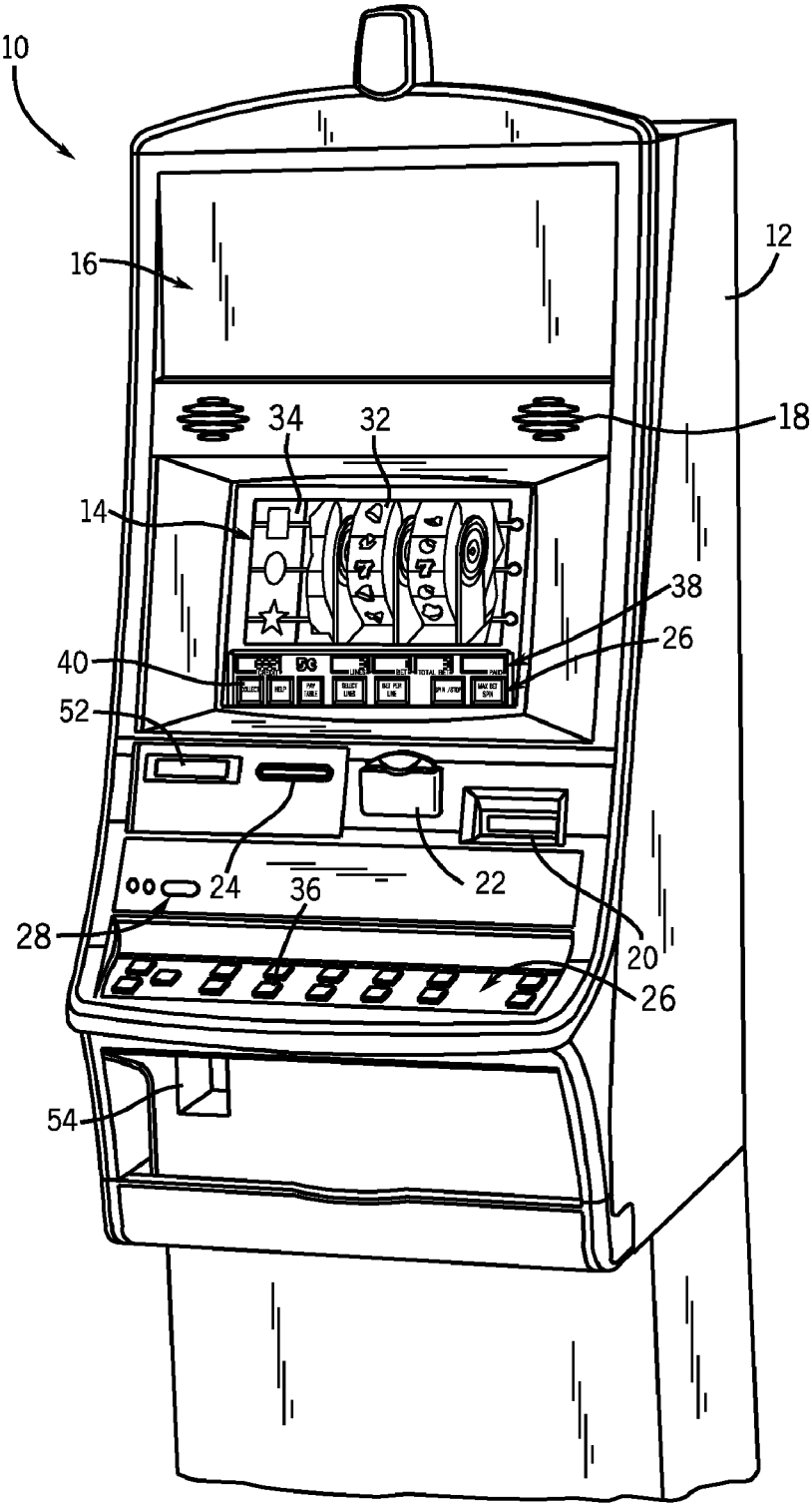
FIG. 1 (PRIOR ART)
FIG. 1 is a perspective view of a free-standing gaming terminal.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is be an electromechanical gaming terminal configured to play mechanical slots, whereas in other aspects, the gaming terminal is an electronic gaming terminal configured to play a video casino game, such as slots, keno, poker, blackjack, roulette, craps, etc. It should be understood that although the gaming terminal 10 is shown as a free-standing terminal of the upright type, the gaming terminal is readily amenable to implementation in a wide variety of other forms such as a free-standing terminal of the slant-top type, a portable or handheld device primarily used for gaming, such as is disclosed by way of example in PCT Patent Application No. PCT/US2007/000792 filed Jan. 11, 2007, titled "Handheld Device for Wagering Games," which is incorporated herein by reference in its entirety, a mobile telecommunications device such as a mobile telephone or personal digital assistant (PDA), a counter-top or bar-top gaming terminal, or other personal electronic device, such as a portable television, MP3 player, entertainment device, etcetera.

The gaming terminal 10 illustrated in FIG. 1 comprises a cabinet or housing 12. For output devices, this embodiment of the gaming terminal 10 includes a primary display area 14, a secondary display area 16, and one or more audio speakers 18. The primary display area 14 and/or secondary display area 16 variously displays information associated with wagering games, non-wagering games, community games, progressives, advertisements, services, premium entertainment, text messaging, emails, alerts or announcements, broadcast information, subscription information, etc. appropriate to the particular mode(s) of operation of the gaming terminal. For input devices, the gaming terminal 10 illustrated in FIG. 1 includes a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements exist and are readily utilizable in any number of combinations to create various forms of a gaming terminal in accord with the present concepts.

The primary display area 14 include, in various aspects of the present concepts, a mechanical-reel display, a video display, or a combination thereof in which a transmissive video display is disposed in front of the mechanical-reel display to portray a video image in superposition over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display is, in various embodiments, a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10, or other form factor, such as is shown by way of example in FIG. 1. The primary display area 14 includes, in relation to many aspects of wagering games conducted on the gaming terminal 10, one or more paylines 30 (see FIG. 3) extending along a portion of the primary display area. In the illustrated embodiment of FIG. 1, the primary display area 14 comprises a plurality of mechanical reels 32 and a video display 34, such as a transmissive display (or a reflected image arrangement in other embodiments), in front of the mechanical reels 32. If the wagering game conducted via the gaming terminal 10 relies upon the video display 34 only and not the mechanical reels 32, the mechanical reels 32 are optionally removed from the interior of the terminal and the video display 34 is advantageously of a non-transmissive type. Similarly, if the wagering game conducted via the gaming terminal 10 relies only upon the mechanical reels 32, but not the video display 34, the video display 34 depicted in FIG. 1 is replaced with a conventional glass panel. Further, in still other embodiments, the video display 34 is disposed to overlay another video display, rather than a mechanical-reel display, such that the primary display area 14 includes layered or superimposed video displays. In yet other embodiments, the mechanical-reel display of the above-noted embodiments is replaced with another mechanical or physical member or members such as, but not limited to, a mechanical wheel (e.g., a roulette game), dice, a pachinko board, or a diorama presenting a three-dimensional model of a game environment.

Video images in the primary display area 14 and/or the secondary display area 16 are rendered in two-dimensional (e.g., using Flash Macromedia™) or three-dimensional graphics (e.g., using Renderware™). In various aspects, the video images are played back (e.g., from a recording stored on the gaming terminal 10), streamed (e.g., from a gaming network), or received as a TV signal (e.g., either broadcast or via cable) and such images can take different forms, such as animated images, computer-generated images, or "real-life" images, either prerecorded (e.g., in the case of marketing/promotional material) or as live footage. The format of the video images can include any format including, but not limited to, an analog format, a standard digital format, or a high-definition (HD) digital format.

The player-input or user-input device(s) 26 include, by way of example, a plurality of buttons 36 on a button panel, as shown in FIG. 1, a mouse, a joy stick, a switch, a microphone, and/or a touch screen 38 mounted over the primary display area 14 and/or the secondary display area 16 and having one or more soft touch keys 40, as is also shown in FIG. 1. In still other aspects, the player-input devices 26 comprise technologies that do not rely upon physical contact between the player and the gaming terminal, such as speech-recognition technology, gesture-sensing technology, eye-tracking technology, etc. The player-input or user-input device(s) 26 thus accept(s) player input(s) and transforms the player input(s) to electronic data signals indicative of a player input or inputs corresponding to an enabled feature for such input(s) at a time of activation (e.g., pressing a "Max Bet" button or soft key to indicate a player's desire to place a maximum wager to play the wagering game). The input(s), once transformed into electronic data signals, are output to a CPU or controller 42 (see FIG. 2) for processing. The electronic data signals are selected from a group consisting essentially of an electrical current, an electrical voltage, an electrical charge, an optical signal, an optical element, a magnetic signal, and a magnetic element.

The information reader 24 (or information reader/writer) is preferably located on the front of the housing 12 and comprises, in at least some forms, a ticket reader, card reader, bar code scanner, wireless transceiver (e.g., RFID, Bluetooth, etc.), biometric reader, or computer-readable-storage-medium interface. As noted, the information reader may comprise a physical and/or electronic writing element to permit writing to a ticket, a card, or computer-readable-storage-medium. The information reader 24 permits information to be transmitted from a portable medium (e.g., ticket, voucher, coupon, casino card, smart card, debit card, credit card, etc.) to the information reader 24 to enable the gaming terminal 10 or associated external system to access an account associated with cashless gaming, to facilitate player tracking or game customization, to retrieve a saved-game state, to store a current-game state, to cause data transfer, and/or to facilitate access to casino services, such as is more fully disclosed, by way of example, in U.S. Patent Publication No. 2003/0045354, published on Mar. 6, 2003, entitled "Portable Data Unit for Communicating With Gaming Machine Over Wireless Link," which is incorporated herein by reference in its entirety. The noted account associated with cashless gaming is, in some aspects of the present concepts, stored at an external system 46 (see FIG. 2) as more fully disclosed in U.S. Pat. No. 6,280,328 to Holch et al. entitled "Cashless Computerized Video Game System and Method," which is incorporated herein by reference in its entirety, or is alternatively stored directly on the portable storage medium. Various security protocols or features can be used to enhance security of the portable storage medium. For example, in some aspects, the individual carrying the portable storage medium is required to enter a secondary independent authenticator (e.g., password, PIN number, biometric, etc.) to access the account stored on the portable storage medium.

Figure 2:
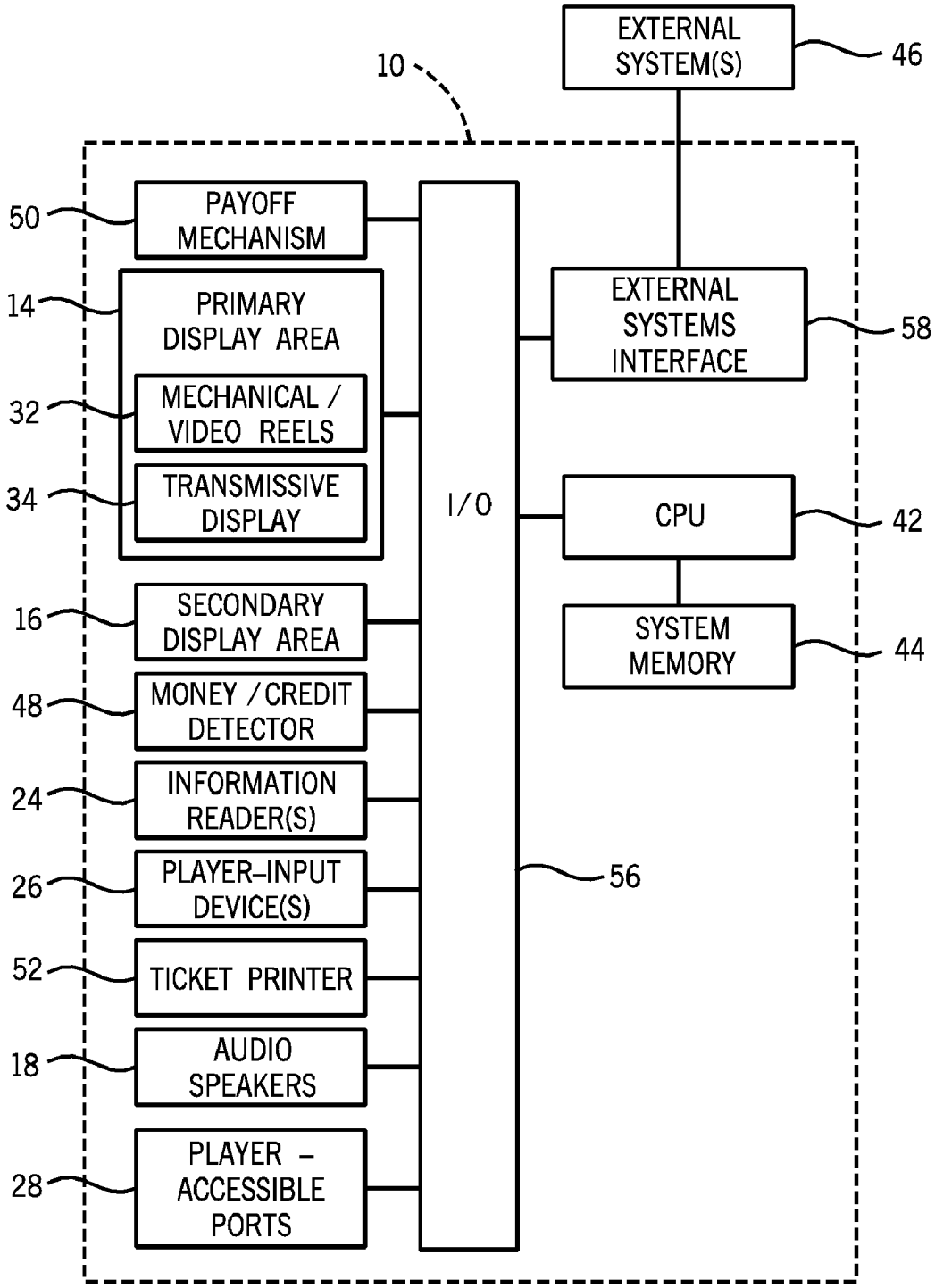
FIG. 2 (PRIOR ART)
FIG. 2 is a schematic view of a gaming system.

Turning now to FIG. 2, the various components of the gaming terminal 10 are controlled by one or more processors (e.g., CPU, distributed processors, etc.) 42, also referred to herein generally as a controller (e.g., microcontroller, microprocessor, etc.). The controller 42 can include any suitable processor(s), such as an Intel® Pentium processor, Intel® Core 2 Duo processor, AMD Opteron™ processor, or UltraSPARC® processor. By way of example, the controller 42 includes a plurality of microprocessors including a master processor, a slave processor, and a secondary or parallel processor. Controller 42, as used herein, comprises any combination of hardware, software, and/or firmware disposed in and/or disposed outside of the gaming terminal 10 that is configured to communicate with and/or control the transfer of data between the gaming terminal 10 and a bus, another computer, processor, or device and/or a service and/or a network. The controller 42 comprises one or more controllers or processors and such one or more controllers or processors need not be disposed proximal to one another and may be located in different devices and/or in different locations. For example, a first processor is disposed proximate a user interface device (e.g., a push button panel, a touch screen display, etc.) and a second processor is disposed remotely from the first processor, the first and second processors being electrically connected through a network. As another example, the first processor is disposed in a first enclosure (e.g., a gaming machine) and a second processor is disposed in a second enclosure (e.g., a server) separate from the first enclosure, the first and second processors being communicatively connected through a network. The controller 42 is operable to execute all of the various gaming methods and other processes disclosed herein.

To provide gaming functions, the controller 42 executes one or more game programs comprising machine-executable instructions stored in local and/or remote computer-readable data storage media (e.g., memory 44 or other suitable storage device). The term computer-readable data storage media, or "computer-readable medium," as used herein refers to any media/medium that participates in providing instructions to controller 42 for execution. The computer-readable medium comprises, in at least some exemplary forms, non-volatile media (e.g., optical disks, magnetic disks, etc.), volatile media (e.g., dynamic memory, RAM), and transmission media (e.g., coaxial cables, copper wire, fiber optics, radio frequency (RF) data communication, infrared (IR) data communication, etc). Common forms of computer-readable media include, for example, a hard disk, magnetic tape (or other magnetic medium), a 2-D or 3-D optical disc (e.g., a CD-ROM, DVD, etc.), RAM, PROM, EPROM, FLASH-EPROM, any other memory chip or solid state digital data storage device, a carrier wave, or any other medium from which a computer can read. By way of example, a plurality of storage media or devices are provided, a first storage device being disposed proximate the user interface device and a second storage device being disposed remotely from the first storage device, wherein a network is connected intermediate the first one and second one of the storage devices.

Various forms of computer-readable media may be involved in carrying one or more sequences of one or more instructions to controller 42 for execution. By way of example, the instructions may initially be borne on a data storage device of a remote device (e.g., a remote computer, server, or system). The remote device can load the instructions into its dynamic memory and send the instructions over a telephone line or other communication path using a modem or other communication device appropriate to the communication path. A modem or other communication device local to the gaming machine 10 or to an external system 46 associated with the gaming machine can receive the data on the telephone line or conveyed through the communication path (e.g., via external systems interface 58) and output the data to a bus, which transmits the data to the system memory 44 associated with the processor 42, from which system memory the processor retrieves and executes the instructions.

Thus, the controller 42 is able to send and receive data, via carrier signals, through the network(s), network link, and communication interface. The data includes, in various examples, instructions, commands, program code, player data, and game data. As to the game data, in at least some aspects of the present concepts, the controller 42 uses a local random number generator (RNG) to randomly generate a wagering game outcome from a plurality of possible outcomes. Alternatively, the outcome is centrally determined using either an RNG or pooling scheme at a remote controller included, for example, within the external system 46.

As shown in the example of FIG. 2, the controller 42 is coupled to the system memory 44. The system memory 44 is shown to comprise a volatile memory (e.g., a random-access memory (RAM)) and a non-volatile memory (e.g., an EEPROM), but optionally includes multiple RAM and multiple program memories.

As shown in the example of FIG. 2, the controller 42 is also coupled to a money/credit detector 48. The money/credit detector 48 is configured to output a signal the controller 42 that money and/or credits have been input via one or more value-input devices, such as the bill validator 20, coin acceptor 22, or via other sources, such as a cashless gaming account, etc. The value-input device(s) is integrated with the housing 12 of the gaming terminal 10 and is connected to the remainder of the components of the gaming terminal 10, as appropriate, via a wired connection, such as I/O 56, or wireless connection. The money/credit detector 48 detects the input of valid funds into the gaming terminal 10 (e.g., via currency, electronic funds, ticket, card, etc.) via the value-input device(s) and outputs a signal to the controller 42 carrying data regarding the input value of the valid funds. The controller 42 extracts the data from these signals from the money/credit detector 48, analyzes the associated data, and transforms the data corresponding to the input value into an equivalent credit balance that is available to the player for subsequent wagers on the gaming terminal 10, such transforming of the data being effected by software, hardware, and/or firmware configured to associate the input value to an equivalent credit value. Where the input value is already in a credit value form, such as in a cashless gaming account having stored therein a credit value, the wager is simply deducted from the available credit balance.

As seen in FIG. 2, the controller 42 is also connected to, and controls, the primary display area 14, the player-input device (s) 26, and a payoff mechanism 50. The payoff mechanism 50 is operable in response to instructions from the controller 42 to award a payoff to the player in response to certain winning outcomes that occur in the base game, the bonus game(s), or via an external game or event. The payoff is provided in the form of money, credits, redeemable points, advancement within a game, access to special features within a game, services, another exchangeable media, or any combination thereof. Although payoffs may be paid out in coins and/or currency bills, payoffs are alternatively associated with a coded ticket (from a ticket printer 52), a portable storage medium or device (e.g., a card magnetic strip), or are transferred to or transmitted to a designated player account. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 alternatively includes a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface or communication device 58, which is connected to the external system 46. The controller 42 communicates with the external system 46 via the external system interface 58 and a communication path (e.g., serial, parallel, IR, RC, 10bT, near field, etc.). The external system 46 includes, in various aspects, a gaming network, other gaming terminals, a gaming server, a remote controller, communications hardware, or a variety of other interfaced systems or components, in any combination. In yet other aspects, the external system 46 may comprise a player's portable electronic device (e.g., cellular phone, electronic wallet, etc.) and the external system interface 58 is configured to facilitate wireless communication and data transfer between the portable electronic device and the controller 42, such as by a near field communication path operating via magnetic field induction or a frequency-hopping spread spectrum RF signals (e.g., Bluetooth, etc.).

The gaming terminal 10 optionally communicates with external system 46 (in a wired or wireless manner) such that each terminal operates as a "thin client" having relatively less functionality, a "thick client" having relatively more functionality, or with any range of functionality therebetween (e.g., an "intermediate client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external systems 46 ("thin client" gaming terminal), or are distributed therebetween in any suitable manner ("intermediate client" gaming terminal).

Figure 3:
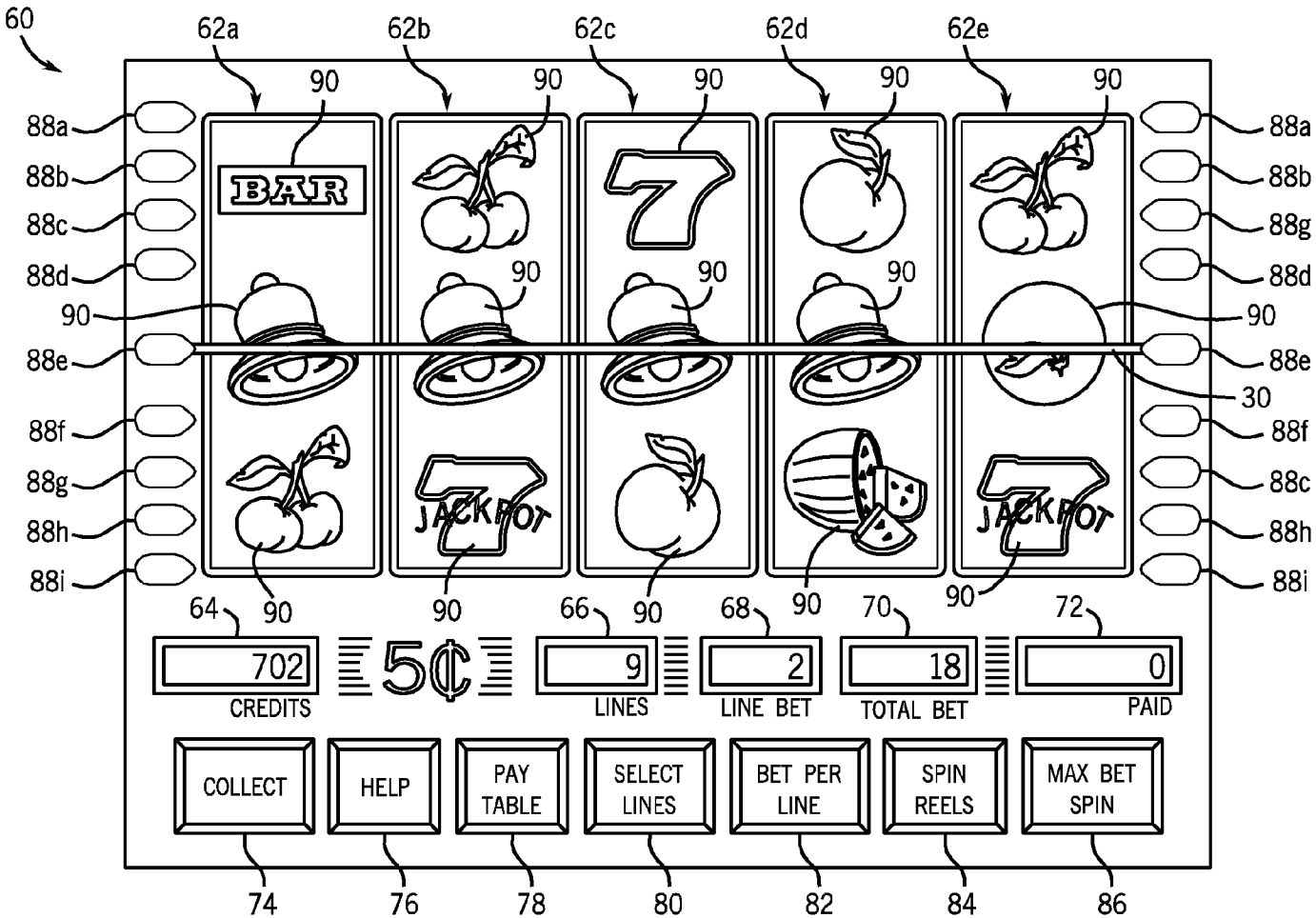
FIG. 3 (PRIOR ART)
FIG. 3 is an image of a basic-game screen of a wagering game that may be displayed on a gaming terminal.

Referring now to FIG. 3, an image of a basic-game screen 60 adapted to be displayed on the primary display area 14 is illustrated, according to one embodiment of the present invention. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

In accord with various methods of conducting a wagering game on a gaming system in accord with the present concepts, the wagering game includes a game sequence in which a player makes a wager, such as through the money/credit detector 48, touch screen 38 soft key, button panel, or the like, and a wagering game outcome is associated with the wager. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 14) through the display of information such as, but not limited to, text, graphics, text and graphics, static images, moving images, etc., or any combination thereof. In accord with the method of conducting the wagering game, the controller 42, which comprises one or more processors, transforms a physical player input, such as a player's pressing of a "Spin Reels" soft key 84 (see FIG. 3), into an electronic data signal indicative of an instruction relating to the wagering game (e.g., an electronic data signal bearing data on a wager amount).

In the aforementioned method, for each data signal, the controller 42 is configured to processes the electronic data signal, to interpret the data signal (e.g., data signals corresponding to a wager input), and to cause further actions associated with the interpretation of the signal in accord with computer instructions relating to such further actions executed by the controller. As one example, the controller 42 causes the recording of a digital representation of the wager in one or more storage devices (e.g., system memory 44 or a memory associated with an external system 46), the controller, in accord with associated computer instructions, causing the changing of a state of the data storage device from a first state to a second state. This change in state is, for example, effected by changing a magnetization pattern on a magnetically coated surface of a magnetic storage device or changing a magnetic state of a ferromagnetic surface of a magneto-optical disc storage device, a change in state of transistors or capacitors in a volatile or a non-volatile semiconductor memory (e.g., DRAM), etc.). The noted second state of the data storage device comprises storage in the storage device of data representing the electronic data signal from the controller (e.g., the wager in the present example). As another example, the controller 42 further, in accord with the execution of the instructions relating to the wagering game, causes the primary display 14 or other display device and/or other output device (e.g., speakers, lights, communication device, etc.), to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by the RNG) that is used by the controller 42 to determine the outcome of the game sequence, using a game logic for determining the outcome based on the randomly generated number. In at least some aspects, the controller 42 is configured to determine an outcome of the game sequence at least partially in response to the random parameter.

The basic-game screen 60 is displayed on the primary display area 14 or a portion thereof. In FIG. 3, the basic-game screen 60 portrays a plurality of simulated movable reels 62*a-e*. Alternatively or additionally, the basic-game screen 60 portrays a plurality of mechanical reels or other video or mechanical presentation consistent with the game format and theme. The basic-game screen 60 also advantageously displays one or more game-session meters and various buttons adapted to be actuated by a player.

In the illustrated embodiment of FIG. 3, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The depicted user-selectable buttons include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present invention does not require them and can be used on gaming terminals having more, less, or different player inputs.

As shown in the example of FIG. 3, paylines 30 extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations are evaluated in accord with various schemes such as, but not limited to, "line pays" or "scatter pays." Line pays are evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present invention. Additionally, though an embodiment with five reels is shown in FIG. 3, different embodiments of the gaming terminal 10 comprise a greater or lesser number of reels in accordance with the present invention.

Figure 4:
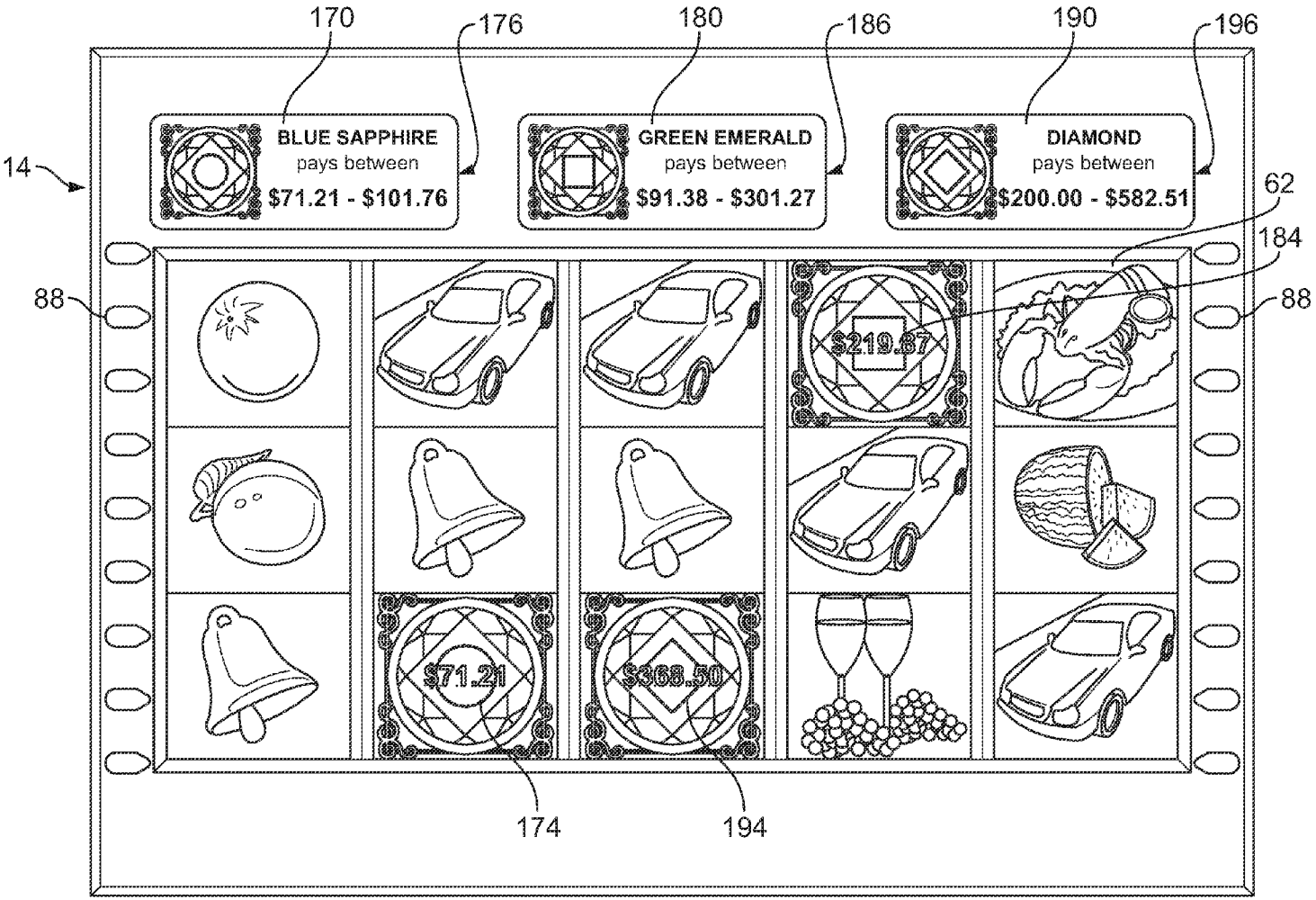
FIG. 4 is an image of the display region of the wagering game that includes individual award values for the different progressive game symbols.

Referring now to FIG. 4, the display 14 of the gaming terminal 10 includes an image of five reels 62 (e.g., mechanical, video, or simulated mechanical reels) having symbols thereon. The player has the ability to win three different levels of a multi-level progressive game, the Blue Sapphire progressive 170, the Green Emerald progressive 180, and the Diamond progressive 190. However, unlike previous progressive games, within each level, there are different possible awards that depend upon the individual values of the progressive game symbols that trigger the progressive award.

For the Blue Sapphire progressive 170, there are Blue Sapphire symbols 174 located on the reels 62. Each of those Blue Sapphire symbols 174 has a certain value that is indicated by the Blue Sapphire value range 176. Thus, different ones of the Blue Sapphire symbols will have different values, with the lowest value being $71.21 and the highest value for any Blue Sapphire symbol 174 being $101.76 (the one shown has a value of $71.21). Similarly, for the Green Emerald progressive 180, there are Green Emerald symbols 184 located on the reels 62 and each of the Green Emerald symbols 184 has a certain value that is indicated by the Green Sapphire value range 186 (lowest Green Emerald symbol 184 having a value of $91.38 and the highest Green Emerald symbol 184 having a value of $301.27). Likewise, for the Diamond progressive 190, there are Diamond symbols 194 located on the reels 62 and each of the Diamond symbols 194 has a certain value that is indicated by the Diamond value range 196 (lowest Diamond symbol 194 having a value of $200.00 and the highest Diamond symbol 194 having a value of $582.51). Because of the range of values, it is possible that all of the progressive game symbols have different individual values.

The number of progressive game symbols present on each reel 62 will depend on the progressive level. Typically, for example, there may be more progressive symbols on each reel 62 for the lower value progressive levels (i.e., the Blue Sapphire progressive 170) than for the higher value progressive levels (i.e., the Diamond progressive 190) because the lower value progressive levels are triggered more frequently. However, there is preferably at least one progressive symbol for each progressive level on each reel 62 to provide the opportunity for one progressive symbol to be located on an active pay line on each of five reels 62.

Figure 5:
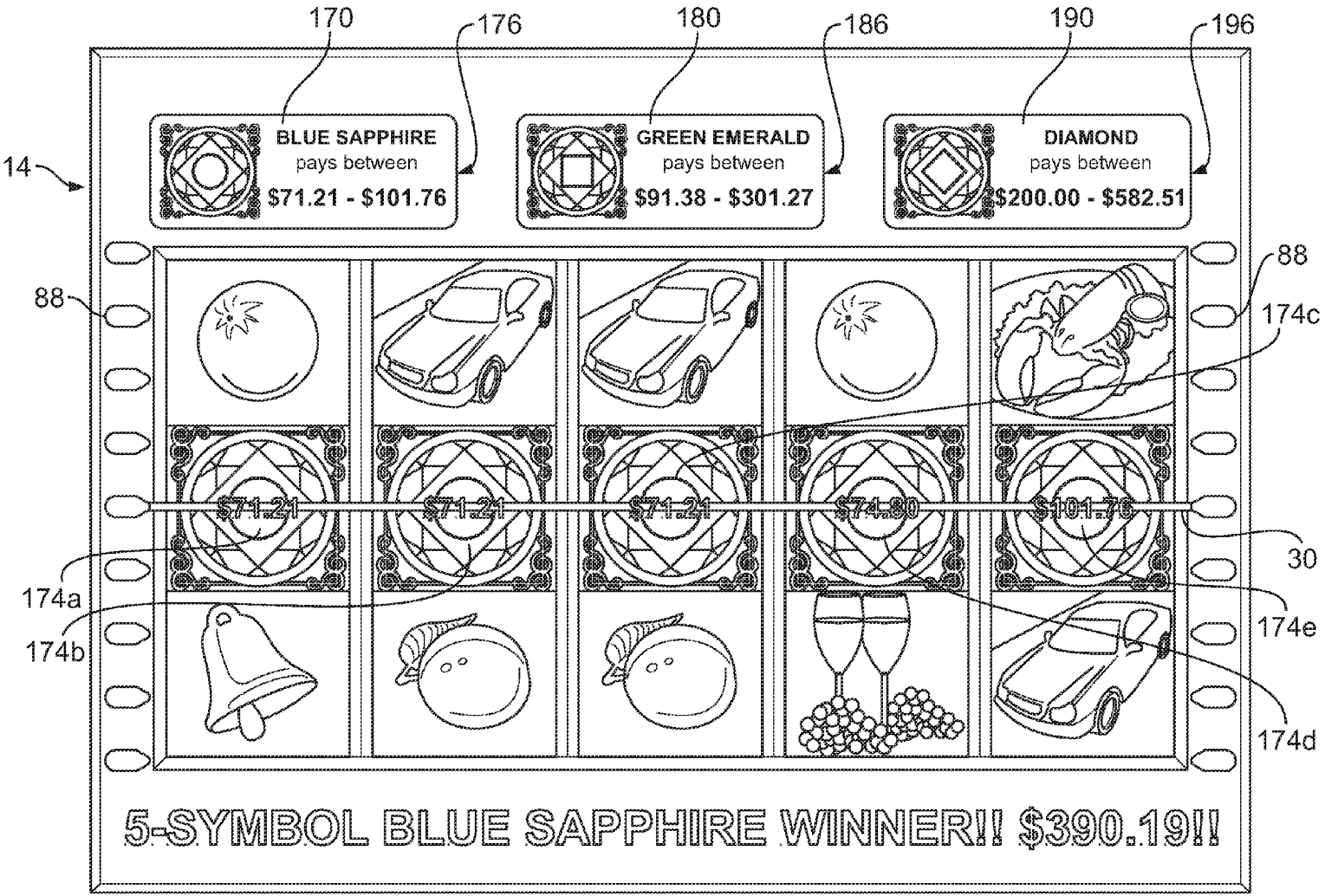
FIG. 5 is an image of the display region of the wagering game in which the player has triggered an award for a first progressive jackpot by aligning five progressive game symbols along the middle pay line.

FIG. 5 illustrates that the player has achieved a progressive award associated with the Blue Sapphire progressive 170. The progressive award has been triggered by five Blue Sapphire symbols 174*a*-174*e* located along the middle active pay line 30. The value of this progressive award is the sum of each of the individual values associated with the five Blue Sapphire symbols 174*a*-174*e*. As such, the player has won a Blue Sapphire progressive 170 with an award value of $390.19.

In FIG. 5, it is noteworthy that if the minimum symbol requirement for triggering the Blue Sapphire progressive 170 is three symbols arranged starting from the left reel, then there are at least three possible awards for the Blue Sapphire progressive 170 based on the state of the game as shown in the display 14 in FIG. 5. Specifically, in addition to the $390.19 award value, the player could have won $213.63 by triggering the Blue Sapphire progressive 170 with only the first three Blue Sapphire symbols 174*a*-174*c*, or $288.43 by triggering the Blue Sapphire progressive 170 with the first four Blue Sapphire symbols 174*a*-174*d*. However, there could be additional Blue Sapphire symbols 174 on one or more of the reels 62 that are not located within the current display region, and each of those additional Blue Sapphire symbols 174 may have values other than $71.21, $74.80, and $101.76 (i.e., the values of the five Blue Sapphire symbols 174*a*-174*e*), resulting in other possible Blue Sapphire symbol combinations with different progressive award values if those other non-displayed Blue Sapphire symbols 174 are involved in triggering the Blue Sapphire progressive 170.

Figure 6:
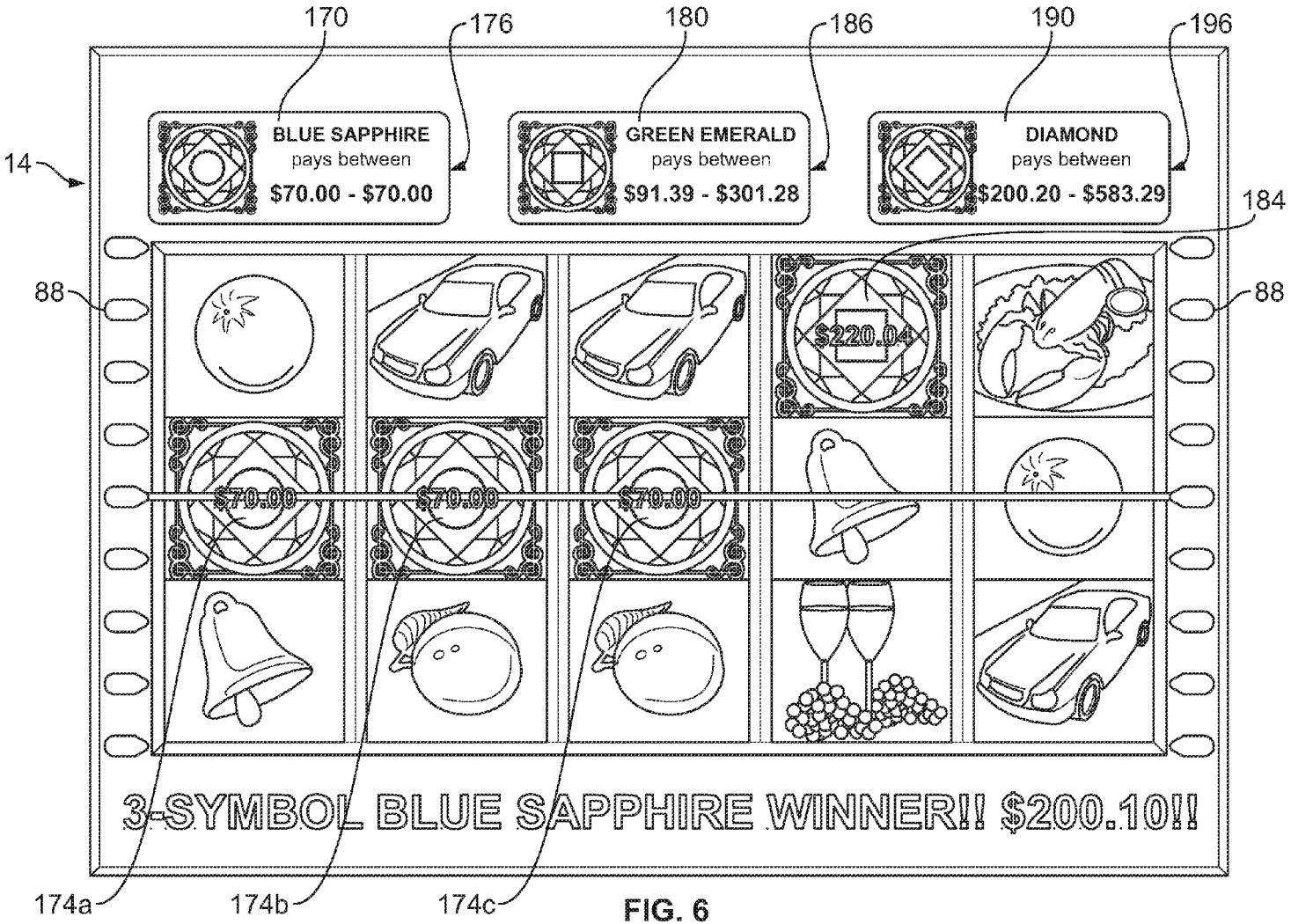
FIG. 6 is an image of the display region of the wagering game in which another player has triggered the award for the first progressive jackpot by aligning three progressive game symbols along the middle payline, immediately after the triggering of the progressive jackpot award in FIG. 5.

FIG. 6 illustrates the display 14 of a different gaming terminal 10 at which a second player is playing the wagering game, immediately after the first player had achieved the Blue Sapphire progressive award 170 in FIG. 5. After the first player achieved the Blue Sapphire progressive 170 in FIG. 5, the values associated with each of the five Blue Sapphire symbols 174*a*-174*e* are reset to a base value, which in this case is $70.00. Typically, the base reset value for the lower-level progressive game symbols (e.g., Blue Sapphire symbols 174) will be lower than the base reset value for the higher level progressive game symbols (e.g. Diamond symbols 194). As additional wagers are received by the players at the gaming terminals 10, the individual value associated with each of the Blue Sapphire symbols 174*a*-174*e* will increase. Of course, as additional wagers are received, the individual values associated with the Green Emerald symbols 184 and the Diamond symbols 194 will also increase.

As described, the progressive symbols that trigger the progressive award are reset to their base levels. However, in an alternative embodiment, all of the progressive symbols within a progressive level (e.g., the Blue Sapphire progressive 170) may be reset to the same base reset value (or different base reset values) after one or more of them have triggered a progressive game award.

In FIG. 6, the second player at a second gaming terminal 10 has again triggered the Blue Sapphire progressive 170 by achieving three Blue Sapphire symbols 174*a*-174*c* along the middle pay line 30. It should be noted that, in another embodiment, only two contiguous Blue Sapphire symbols 174*a* and 174*b* could have triggered a progressive award. Because the first player had just achieved the Blue Sapphire progressive with the same symbols, the three Blue Sapphire symbols 174*a*-174*c* are at their base value of $70.00. Accordingly, the second player has won $210.00.

FIG. 6 also illustrates how a progressive symbol has its individual value incremented as the gaming terminals 10 continue to receive wagering inputs from players without the associated progressive level being achieved. In particular, compared with its value of $219.87 in FIG. 4, the Green Emerald symbol 184 on the fourth reel 62 has increased its value to $220.04 in FIG. 6. This is due to the fact that the Green Emerald symbol 184 has not been involved in a winning symbol combination for the Green Emerald progressive 180 between FIG. 4 and FIG. 6, but it has received its percentage of each wager input from players at the gaming terminals 10.

By assigning and displaying the individual value for each of the progressive symbols, the player can better understand the possible progressive game awards as the progressive symbols move through the display region on the moving reels 62, especially when the reels 62 undergo slow movement as they are about to stop. Furthermore, even when the player does not win the progressive award, he or she can understand that the values of the individual progressive symbols are increasing as he or she continues to play the game. In one preferred embodiment, the individual value for a progressive symbol is shown as increasing when that symbol is in a static position within the display region after the player has played the wagering game or when the symbol is slowly moving on the reels. In other words, the player actually visualizes the incremental increase in value on the symbol itself. All of these progressive game features help to maintain the player's interest in the base game or in other types of base games that provide access to these same progressive games.

Figure 7:
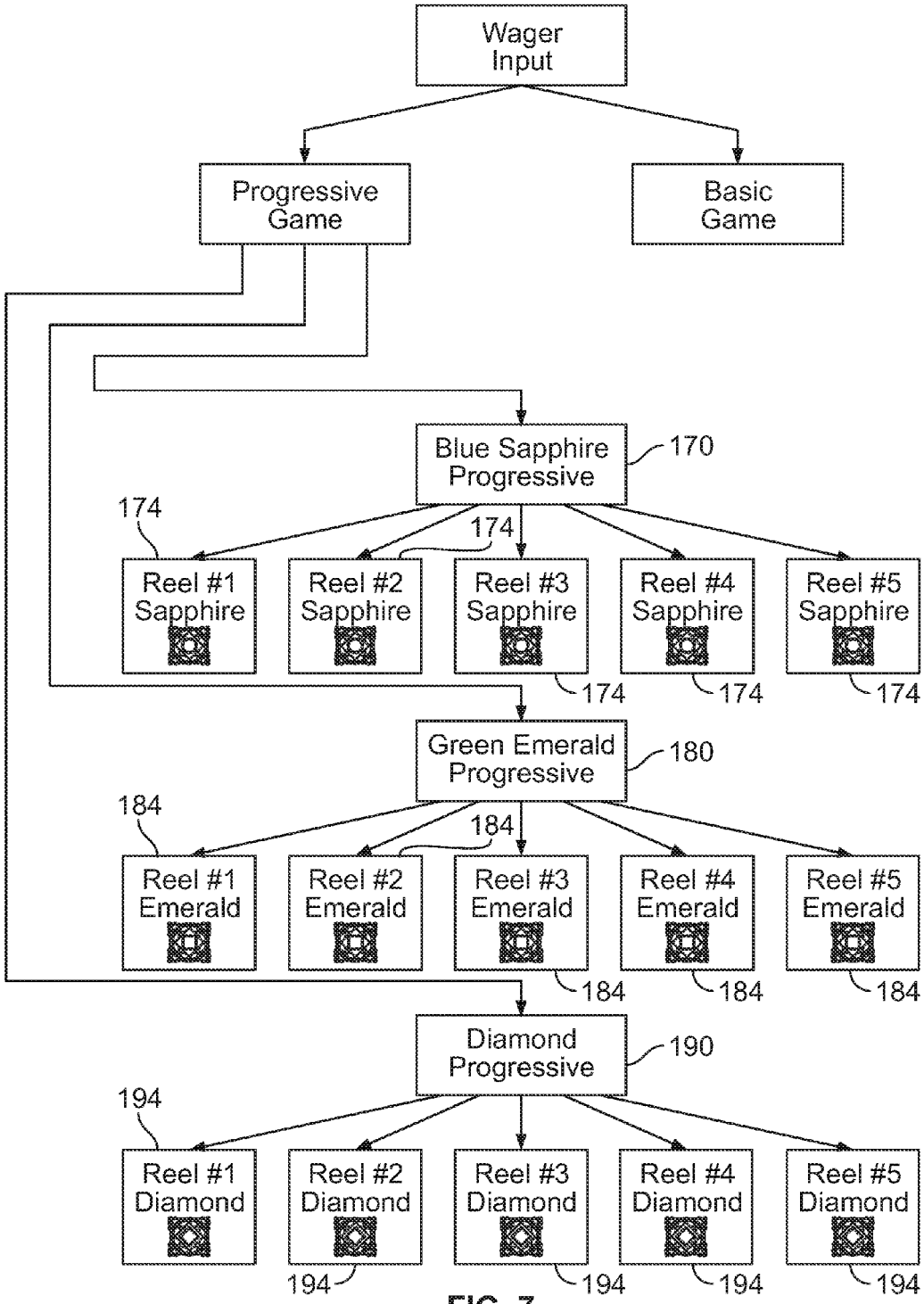
FIG. 7 is a flowchart showing how the portions of the input wagers are distributed to the various progressive levels and the progressive symbols within each level.

FIG. 7 schematically illustrates the allocation of each wager input received at one of the gaming terminals 10, thereby providing access to the progressive game having the Blue Sapphire progressive 170, the Green Emerald progressive 180, and the Diamond progressive 190. For each wager input, the majority of that wager input is typically allocated to the basic game and is used for funding the various winning symbol combinations on the reels 62. A minority of that wager input is allocated to the progressive game, which may have various progressive levels as in the illustrated embodiment. In this case, a first portion of the progressive game's funding from the wager input is allocated to the Blue Sapphire progressive 170. A second portion of the progressive game's funding from the wager input is allocated to the Green Emerald progressive 180. A third portion of the progressive game's funding from the wager input is allocated to the Diamond progressive 190. The first portion, second portion, and third portion may be equal, or may be different values.

With respect to the first portion that has been allocated to the Blue Sapphire progressive 170, it is used to increase the individual values of each of the Blue Sapphire symbols 174 on the reels 62. The percentages of the first portion that are assigned to the Blue Sapphire symbols 174 may be equal (e.g., 20% each) or may be unequal (e.g., the three Blue Sapphire symbols 174 on the first three reels receive 25%, the Blue Sapphire symbol 174 on the fourth reel receives 15%, and the Blue Sapphire symbol 174 on the fifth reel receives 10%). Similarly, the percentages of the second portion assigned to each of Green Emerald symbols 184 may also be equal or unequal. Likewise, the percentages of the third portion assigned to each of the Diamond symbols 194 may be equal or unequal.

For simplicity purposes, FIG. 7 illustrates an embodiment in which there is only one type of progressive symbol 174, 184, 194 on each reel 62 and that each progressive 170, 180, 190 has only five progressive symbols in total. However, as discussed previously, the present invention contemplates that the lower value progressive (i.e., the Blue Sapphire progressive 170) may have more progressive symbols relative to the other higher value progressive levels because the lower value progressive is typically triggered more frequently. Furthermore, within one progressive level, there may be more progressive symbols on some reels than on other reels. For example, there may be three or more Blue Sapphire symbols 174 on each of the first three reels 62, and only one or two Blue Sapphire symbols 174 on the last two reels 62. And, when there is more than one of the same type of progressive symbol (e.g. multiple Blue Sapphire symbols 174) on a single reel, the percentage of the wager input's allocation to each progressive symbol may be different. The number of progressive symbols on each reel 62 is also a function of the total number of symbols positions on each reel 62 since there generally should not be too many or too few progressive symbols relative to the overall number of symbols on a particular reel 62.

While the incrementing of the progressive symbols 174, 184, 194 has been discussed as being based on the wager input activity associated with the play of the base game, other types of game play activities can be used as well to increment the values. For example, the occurrence of certain symbols or certain symbol combinations can trigger the incrementing of one or more of the progressive symbols 174, 184, 194. Thus, while the funds from the wager inputs ultimately may be used for funding the progressive symbols 174, 184, 194, the actual game play activity that increments the value of the progressive symbols 174, 184, 194 can be other game play events.

Figure 8:
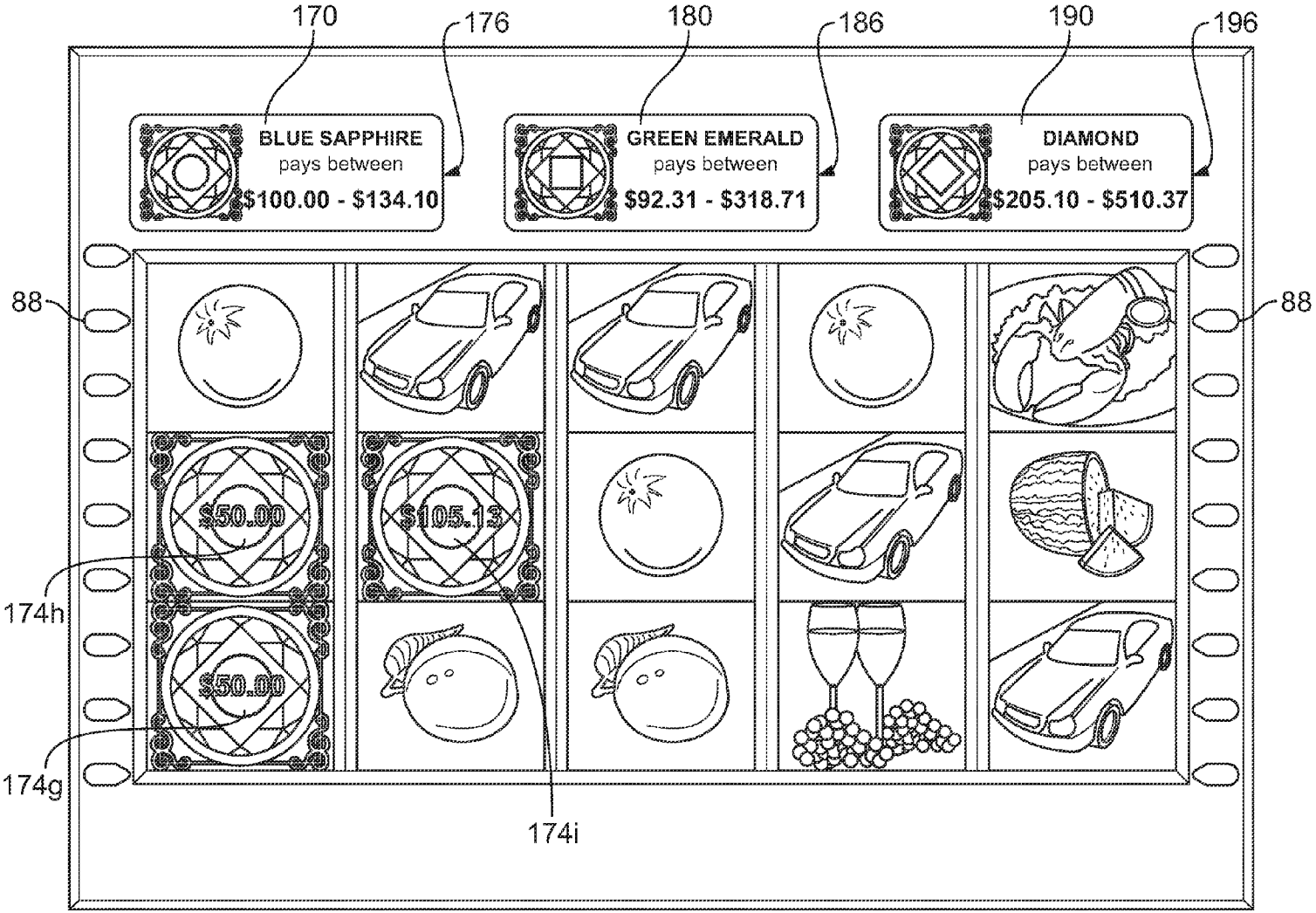
FIG. 8 is an image of the display region of the wagering game in which a progressive symbol having a certain value has been split to include multiple progressive symbols.

FIG. 8 illustrates a variation to the progressive game in which a single progressive symbol is copied onto an adjacent non-progressive symbol on the same reel when a predetermined condition is achieved. In FIG. 8, a Blue Sapphire symbol 174*g* on the first reel 62 at its lowermost symbol location has achieved a certain value, which then causes it to split into two different Blue Sapphire symbols 174*h* and 174*g*. As can be seen by the value range 176 for the Blue Sapphire progressive 170, the minimum individual value for all of the Blue Sapphire symbols 174 is $100.00. Consequently, the Blue Sapphire symbol 174*g* that was located on the first reel 62 had a value of $100.00, which caused it to split into the two different Blue Sapphire symbols 174*h* and 174*g*, each of which has a value of $50.00. By splitting a single Blue Sapphire progressive symbol 174*g* into two or more progressive symbols, "clumps" of progressive symbols are created, which increases the chances for the player to achieve the progressive game board. For example, each of the Blue Sapphire symbols 174*h* and 174*g* can now be a part of winning progressive symbol combination with the Blue Sapphire progressive symbol 174*i* along different pay lines 30. Because a reel typically has a fixed number of symbol locations, the clumping process may involve the addition of a reel symbol location to a reel, or it can simply replace a symbol in a symbol location to keep the number of symbol locations constant. Accordingly, the overall payout of the progressive game award may substantially increase by clumping these additional progressive game symbols in a display region because this process may trigger multiple progressive awards on multiple pay lines. Also, while the "clumping" feature has been illustrated with respect to progressive symbols on the same reel, the "clumping" feature may also involve transposing the progressive symbol to an adjacent reel.

The predetermined condition that may trigger the "clumping" features in FIG. 8 may include achieving a certain value for a single progressive game symbol. Alternatively, because this is an advantage for the player, this clumping feature may be triggered only when the player's wager input is at a certain high-level rate. Another predetermined condition that may cause this "clumping" feature could be the fact that the player places a side wager so as to activate the "clumping" feature. Combinations of each of these triggering conditions are possible as well.

Figure 9:
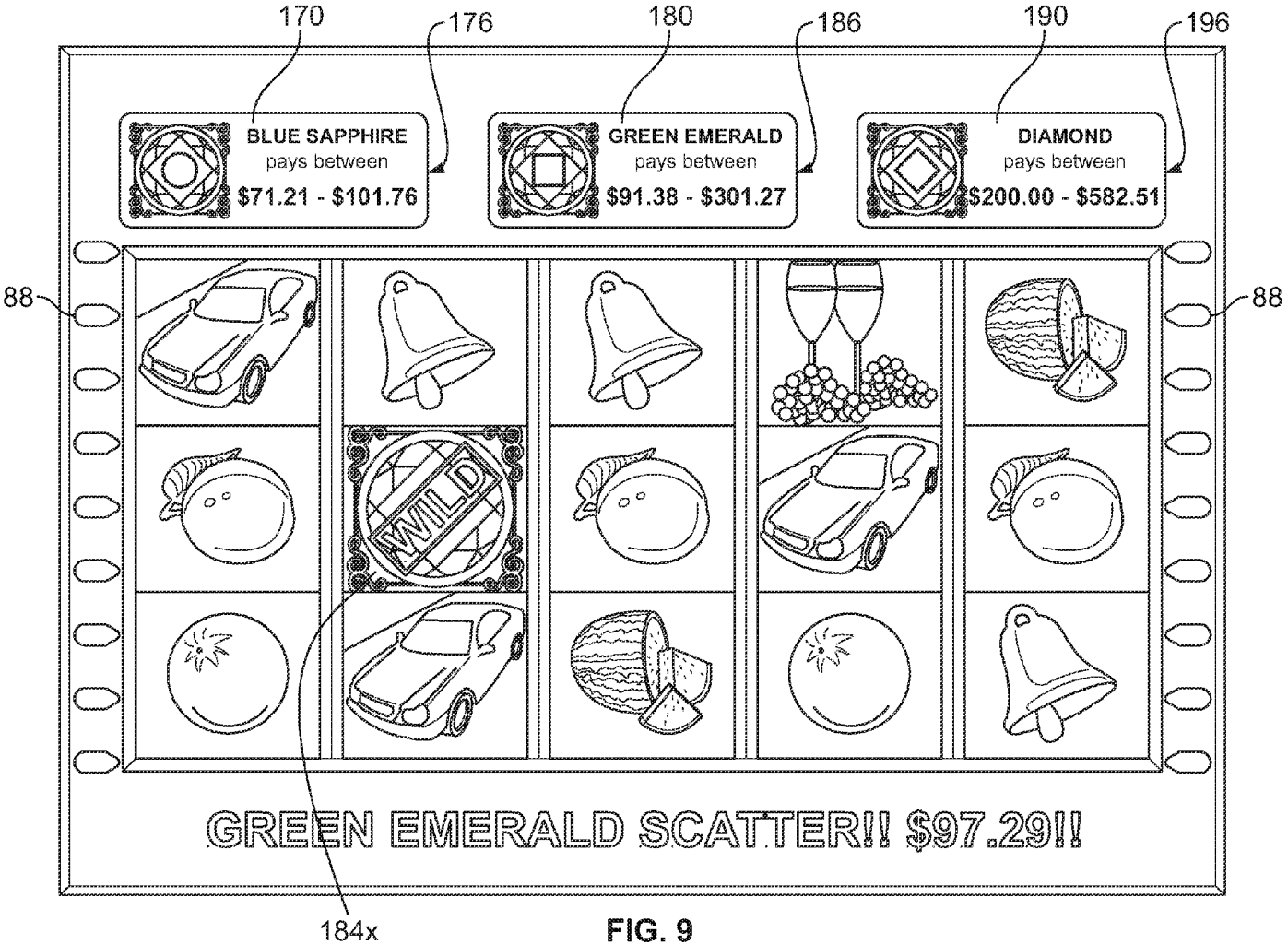
FIG. 9 is an image of the display region of the wagering game with a progressive game award being triggered via a scatter progressive symbol and the progressive symbol also provides a different function, which in this case, is a "wild" function, that may affect the basic game awards.

FIG. 9 illustrates two other variations to the progressive game. In particular, unlike the triggering condition for the progressive award being progressive game symbols located on an active pay line 30, the progressive game award may be triggered when a single progressive game symbol is located anywhere within the display region (i.e., a "scatter" payout). Here, the Green Emerald symbol 184*x* on the second reel is located in the display region, and has resulted in the player winning $97.29. It should be noted that, in a "scatter" type of progressive payout, the percentage of the wager input that each progressive symbol receives (See FIG. 7) can be equal because the chance that each progressive symbol appears in the display area can be the same or very similar.

Additionally, as shown in FIG. 9, one or more of the progressive game symbols may morph into a different type of symbol after it has been involved in a progressive game award payout to a player. In this instance, the Green Emerald symbol 184*x* has morphed into a "wild" symbol, which increases the player's chances for achieving an award on the underlying base game. In this instance, because the Green Emerald symbol 184*x* is now a "wild" symbol, it can be used in combination with the middle "orange" symbol on the first reel 62 and the middle "orange" symbol on the third reel to result in a winning symbol combination of three adjacent "orange" symbols. The progressive game symbol can morph into other types of symbols as well. For example, it can simply morph into one of the various types of basic game symbols (e.g., "bell" symbol, "car" symbol, etc) which would also increase the player's chances for achieving a winning symbol combination in the basic game. In short, the progressive game symbol, in some predetermined conditions, may "morph" into a basic game symbol that may provide further opportunities for the player to achieve a winning symbol combination in the base game. These predetermined conditions can be when the progressive game symbol is a part of a winning progressive symbol combination (as shown), when a certain number of progressive game symbols that are not involved with the winning progressive symbol combination are in the display region, or when the progressive game symbol has achieved a certain individual value (e.g., has a high individual value, or a low individual value, or some middle range of values).

In a further embodiment, if the Green Emerald symbol 184*x* is not part of a scatter-payout arrangement (i.e., when winning progressive symbol combinations must be aligned along a pay line 30), but still acts as a "wild" symbol to trigger a winning symbol combination in the base game, the fact that it was part of the winning symbol combination may also causes its individual value to increase at a higher rate or to a higher value, which is beneficial for subsequent plays of the wagering game. Or, a certain symbol or symbols (e.g., progressive value enhancer symbol) in the base game may cause the progressive game symbols to increase in value at a higher rate or to a higher overall value when that certain symbol or symbols is adjacent to one of the progressive game symbols in the display region. Thus, in these further embodiments, the base game symbols may have an effect on the value of the progressive game symbols. In summary, the game-play activity in the base game, whether it is wager-inputs, accumulation of certain symbols, or the occurrence of symbols or symbol combination, will cause the values of the progressive award symbols to increase.

In the illustrated embodiments involving pay lines, it has been assumed that the triggering progressive game symbol combination must include a progressive game symbol on the leftmost reel and continue with a corresponding progressive game symbol across the adjacent second and third reels (or more reels). This left-to-right arrangement is common in many slot type wagering games. However, the progressive game awards could also be triggered along active pay lines in a right-to-left arrangement or in both right-to-left and left-to-right arrangements, or in any other pre-defined orientation.

If the progressive game follows only a left-to-right payout arrangement, then the likelihood that the progressive symbols on the fourth and fifth reel will be involved in a progressive game award is less than the symbols on the first three reels. To ensure that all of the progressive game symbols within one progressive game level (e.g., the Blue Sapphire progressive 170) have roughly the same value, the percentage of the coin input allocated to the progressive game symbols on the fourth and fifth reels may be less than the percentages allocated to the progressive game symbols on the first, second, and third reels. This variable incrementing of the progressive game symbols in which different progressive symbols receive different percentages was also discussed above relative to FIG. 7. If the progressive game follows only a left-to-right payout arrangement, then another method by which to keep the individual values of all symbols within one progressive level relatively the same is to have different base reset values for each of those progressive symbols within one progressive level.

In the illustrated embodiments, the value range 176, 186, 196 provides the current value range for all of the progressive game symbols within the respective progressives games 170, 180, and 190. If the progressive award is triggered by three, four, or five contiguous progressive game symbols along an active pay line, then a total award range can be displayed as a range between the lowest possible award (combination involving three progressive symbols with the lowest individual values) and the highest possible award (combination involving five progressive symbols with the highest individual values). The total award value range could be displayed in addition to the individual value range (shown in FIGS. 4-6, 8-9), or in place of the individual value range.

In addition, the value range 176, 186, 196 that is displayed to the player could also include a minimum possible symbol amount (e.g., a progressive symbol's base reset value) and a fixed maximum amount. The fixed maximum amount may be the maximum value of a symbol before it must trigger a progressive award win. Or, if the maximum value is reached, and no progressive win has been triggered, any additional overage in contributions could be directed to the value of other progressive symbols (in the same progressive level or a different level). Alternatively, the overage could go into a fund that is used when a progressive symbol's value is reset after an award, such that the symbol resets to a value that is higher than its typical reset value.

In a further alternative when the progressive symbol has a fixed maximum value, the progressive game symbol can split into multiple symbols, as discussed in the "clumping" feature of FIG. 8. Thus, the players may visualize a value of a progressive game symbol 174, 184, 194 increase to a point near the maximum value while viewing one or more of the value ranges 176, 186, 196, knowing the symbol may split to create a "clump" of identical progressive game symbols that may enhance the likelihood a progressive award. By splitting the symbols to create the "clump", its value is also split so that both values of the symbols are below the fixed maximum value. Each "clumped" symbol can then be individually incremented.

While the progressive game symbols 174, 184, 194 have been described as having individual values that are used to determine the overall progressive award, other progressive award types are available as well. For example, the progressive game may not award a monetary value, but instead award a number of free spins of the reels (i.e., a non-monetary parameter). As players continue to play the progressive game without the progressive jackpot being achieved, the number of free spins continues to increase (just like the progressive award jackpot increases as players continue to play the progressive game). When the player achieves the progressive jackpot in such a game, he or she is awarded the current number of free spins associated with the progressive jackpot and is permitted to play that number of free spins.

Alternatively, in another example of a non-monetary parameter that could be provided by the progressive award, the overall value of a progressive jackpot may be dictated by the player's picks from a large array of player-selectable elements. Each player-selectable element may mask an underlying award value or a symbol that, when collected with other symbols, produces a higher progressive payout. If the player's odds for achieving a higher progressive jackpot award are increased when the player has more picks, then the present invention has further applicability to such a progressive game in that each of the progressive game symbols 174, 184, 194 may be associated with a number of picks that the player is permitted to make from the array.

Examples of progressive games that have progressive awards that are dictated by other quantifiable non-monetary game parameters are disclosed in U.S. Publication No. 2009-0247292, U.S. Publication No. 2010-0016060, U.S. Publication No. 2005-0003880, and Ser. No. 12/905,519, filed Oct. 15, 2010 (entitled "GAMING SYSTEM WITH NON-CASH-BASED PROGRESSIVE AWARDS"), which are commonly owned and herein incorporated by reference in their entireties. The various types of non-monetary game parameters can include one or more of the following: number of player selections, number of free spins, extra wilds, multipliers, credits, picks, paylines, rolls of dice, number of wins, pooper savers, cascading events, number of played games, spinning streaks events, random bonuses, nudges, and random play enhancements (See Ser. No. 12/905,519, filed Oct. 15, 2010). In summary, in addition to the individual monetary award values associated with each of the progressive game symbols 174, 184, 194 in the illustrated embodiments, the progressive game symbols 174, 184, 194 could include some other displayed non-monetary game parameter that can be incremented as the progressive game continues.

When considering both monetary awards and non-monetary game parameters, various hybrid embodiments for a single progressive game are available as well. For example, the Blue Sapphire progressive symbols 174 could be associated with monetary progressive awards, the Green Emerald progressive symbols 184 could be associated with a first type of the non-monetary game parameters (e.g., multipliers), and the Diamond progressive symbols 194 could be associated with a second type of the non-monetary game parameters (e.g., free spins). In another progressive game, the individual values of the progressive game symbols within one level could include both monetary awards and non-monetary parameters. Thus, in such a progressive game, if the player achieves three Blue Sapphire progressive symbols 174 to indicate a progressive award, then the player could win monetary values on two Blue Sapphire progressive symbols 174 (e.g., $71.05 and $75.48) and win a certain non-monetary award (e.g., 20 free spins) on the third Blue Sapphire progressive symbol 174.

While the present invention has been described with regard to be progressive award value being equal to the sum of the individual values of the progressive game symbols 174, 184, 194 that triggered the progressive award, there are other options for having the individual symbols dictate the overall progressive award as well. For example, one or more of the progressive game symbols 174, 184, 194 may have some type of multiplier value that slowly increases. Hence, if such a progressive game symbol 174, 184, 194 were to be included in a winning symbol combinations for progressive award, the sums of the other ones within a winning combination would first be added, and then the sum would be multiplied by the value associated with the multiplier.

Figure 10:
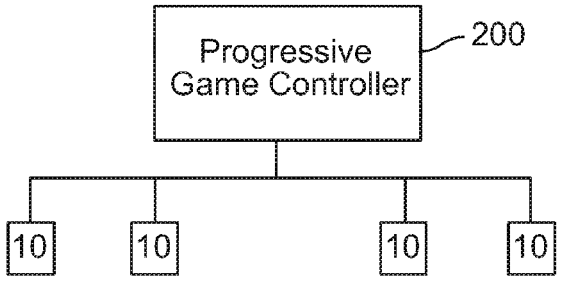
FIG. 10 is a schematic representation of a progressive game system.

As shown in FIG. 10, the progressive game that is accessed at the gaming terminals 10 is typically controlled by a progressive game controller 200 located external (e.g., external progressive system 46 in FIG. 2) to the gaming terminals 10 and which is also coupled to the plurality of different gaming terminals 10. The progressive game controller 200 controls various aspects of the progressive game, including the receiving of signals from each participating gaming terminal 10 that correspond to the players' wager inputs and allocating those wager inputs to the progressive symbols in general accordance with what is shown in FIG. 7. The progressive game controller 200 also sends signals to each of the participating gaming terminals 10 that would instruct those gaming terminals 10 to update the individual values of the progressive game symbols 174, 184, 194 based on the wager inputs. Similarly, when a progressive award is awarded to a player at one of the gaming terminals 10, the progressive game controller also sends signals instructing the gaming terminals 10 to display the base reset values for the progressive game symbols that triggered the progressive award. Thus, the various functions of the progressive game typically involve the external progressive game controller 200 and a local controller in each of the gaming terminals 10 (e.g., the CPU 42 in FIG. 2).

Figure 11A:
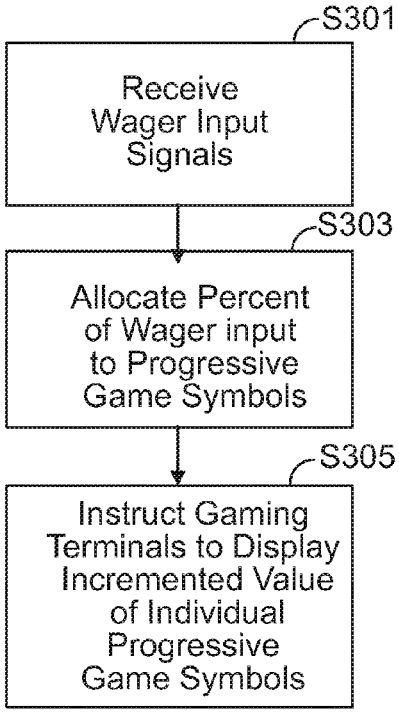
FIGS. 11A and 11B are examples of algorithms that may be used in conjunction with the progressive game.
Figure 11B:
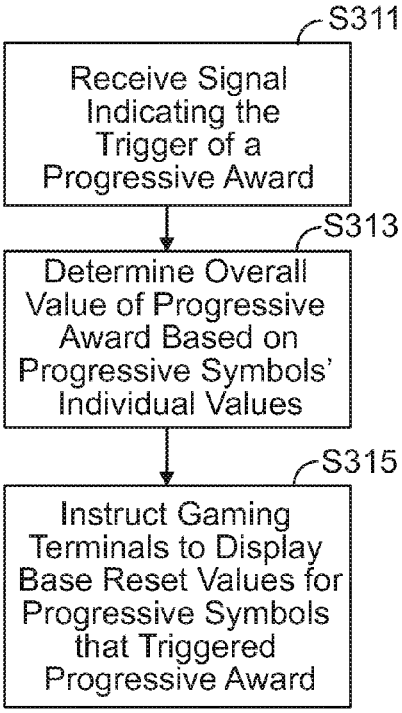

FIGS. 11A and 11B illustrate the algorithms that may be executed by the progressive game controller 200 of FIG. 10. In FIG. 11A, at step S301, the progressive game controller 200 receives the wager input signals from the gaming terminals 10. Based on these wager inputs, at step S303, the progressive game controller 200 allocates a percentage of the wager inputs to the various progressive game symbols 174, 184, 194 in general accordance with FIG. 7. Then, at step S305, the progressive gaming controller 200 instructs the gaming terminals 10 to display an updated incremented value for each of the individual progressive game symbols 174, 184, 194 based on the wager inputs. The transmission of the instructions to the gaming terminals 10 to display the incremented values may occur on a standard periodic basis (e.g., every 1 second or 5 seconds) after multiple wager input signals have been received in step S301, the wager amounts have been accumulated, and then those wager amounts have been allocated in step S303.

In FIG. 11B, an algorithm that may be used in the award process is illustrated. At step S311, the progressive game controller 200 receives a signal from the gaming terminal 10 indicating that a progressive award has been triggered. At step S313, the progressive game controller 200 determines the overall value of the progressive award based on the individual values of the progressive symbols that triggered the progressive award. The progressive game controller 200 ensures that all the wager inputs from the various gaming terminals 10 that occurred prior to the triggering of the progressive award are included in the overall value to be awarded the player. The progressive gaming terminal 200 would relay that calculated overall value to the triggering gaming terminal 10. And, at step 315, the progressive game controller would then instruct all gaming terminals 10 to display the base reset values for those progressive symbols that triggered the progressive award.

Furthermore, it should be noted that different types of wagering games can provide access to this progressive game. In other words, players may be competing in the same progressive game, but playing different types of underlying basic games (e.g., slots games and video poker games) at the same or at different gaming terminals 10. In poker, for example, the progressive symbols could be associated with certain types of cards, card ranks, or card combos.

Each of these embodiments and obvious variations thereof is contemplated as falling within the spirit and scope of the claimed invention, which is set forth in the following claims.

What is claimed is:

1. A method of conducting a wagering game on a gaming system, the wagering game including a base game and a progressive game having progressive game awards that are indicated by progressive-game symbols, the method comprising:

receiving, from a wager-input-device, a wager input from a player playing the wagering game;

allocating, by use of at least one controller, a portion of the wager input to the progressive game, the allocated portion being assigned to the progressive-game symbols;

presenting, on at least one display, the base game with a plurality of moveable reels having symbols thereon that define a symbol array, the symbols including the progressive-game symbols, each of the progressive-game symbols having a displayed individual value that is associated therewith and displayed within the symbol array;

in response to a first triggering condition, awarding a first progressive game award to the player, the first progressive game award based on the displayed individual values of a first group of progressive-game symbols being displayed on the plurality of moveable reels, and in response to a second triggering condition, awarding a second progressive game award to the player, the second progressive game award based on the displayed individual values of a second group of progressive-game symbols being displayed on the plurality of moveable reels, the first progressive game award being different from the second progressive game award.

2. The method of claim 1, further including, displaying the incrementing of the displayed individual values of the progressive-game symbols while the moveable reels are stopped or moving slowly such that the incrementing is viewable by the player.

3. The method of claim 1, wherein the wagering game is conducted on a gaming terminal, and the displaying occurs on a display associated with the gaming terminal.

4. The method of claim 1, further including, after awarding the first progressive game award, resetting each of the progressive-game symbols from the first group of progressive-game symbols to a base reset value while other progressive-game symbols are maintained at previous values.

5. The method of claim 1, wherein the first triggering condition is at least one progressive game symbol scattered at any symbol location within the symbol array, and the first progressive game award has a value equal to the summation of the values of the at least one progressive game symbol.

6. The method of claim 1, wherein the second triggering condition is at least two progressive-game symbols located on an active pay line extending across the symbol array, and the second progressive game award has a value equal to the summation of the values of the at least two progressive-game symbols.

7. The method of claim 1, wherein the progressive game includes at least a first progressive level and a second progressive level, some of the progressive-game symbols being associated with only the first progressive level, some of the progressive-game symbols being associated with only the second progressive level.

8. The method of claim 1, wherein the displayed individual values of the progressive-game symbols within the first group are different.

9. The method of claim 1, wherein at least one of the progressive-game symbols, in a certain condition, morphs into a symbol having an additional function that affects the outcome of an underlying basic game of the wagering game.

10. The method of claim 1, wherein at least one other symbol on the plurality of reels associated with the base game affects the individual value of a progressive game symbol when positioned adjacent to the progressive game symbol.

11. A control module for a gaming system including a plurality of gaming terminals for playing wagering games having a plurality of moveable reels that define a symbol array, the wagering games provide access to a progressive game having multiple progressive game awards that are indicated by progressive-game symbols, each of the progressive-game symbols has a base reset value and an individual value that increases from the base reset value in response to wager inputs at the plurality of gaming terminals, each of the gaming terminals including a display for displaying the plurality of reels, the gaming-system control module comprising:

at least one controller configured to:

allocate a portion of a wager input received from a first player at a first gaming terminal to the progressive-game symbols, each of the progressive-game symbols receiving a percentage of the allocated portion of the wager input;

determine an updated value of each of progressive-game symbols based on the allocated portion of the wager input received from the first player; and instruct each of the plurality of gaming terminals to display within the symbol array, on their respective displays, the updated values of the progressive-game symbols during the wagering game.

12. The gaming-system control module of claim 11, wherein the controller is further operative to determine a first progressive game award associated with a first group of progressive-game symbols to the first player at the first gaming terminal in response to the first group of symbols being displayed, the overall value of the first progressive game award corresponding to the individual values of each symbol within the first group of progressive-game symbols.

13. The gaming-system control module of claim 12, wherein the controller is further operative to determine a second progressive game award associated with a second group of progressive-game symbols to a second player at the second gaming terminal in response to the second group of symbols being displayed, the overall value of the second progressive game award corresponding to the individual values of each symbol within the second group of progressive-game symbols.

14. The gaming-system control module of claim 12, wherein the controller is further operative to, after determining the first progressive award, maintain the individual values of the progressive games symbols that were not part of the first group of symbols, and reset the progressive-game symbols that were a part of the first group of symbols to a base reset value.

15. The gaming-system control module of claim 12, wherein the wagering game includes at least one pay line extending through the symbol array, the first group of progressive-game symbols being arranged along the at least one pay line to achieve the first progressive game award.

16. The gaming-system control module of claim 12, wherein the wagering game includes at least one pay line extending through the symbol array, the first group of progressive-game symbols being scattered at any symbol location to achieve the first progressive game award, the first group of progressive-game symbols including at least one progressive symbol.

17. The gaming-system control module of claim 11, wherein the progressive wagering game includes at least a first progressive level and a second progressive level, some of the progressive-game symbols being associated with only the first progressive level, some of the progressive-game symbols being associated with only the second progressive level.

18. The gaming-system control module of claim 17, wherein the progressive-game symbols associated with the second progressive level have a higher base reset value than the progressive-game symbols associated with the first progressive level, and the progressive-game symbols associated with the second progressive level receive a different percentage of the allocated portion of the wager input than the progressive-game symbols associated with the first progressive level.

19. The gaming-system control module of claim 11, wherein the percentages of the allocated portion of the wager input to at least some of the progressive-game symbols are different.

20. The gaming-system control module of claim 19, wherein the wagering game includes at least one pay line extending through the symbol array and the symbols are evaluated from left-to-right along the at least one pay line, the progressive-game symbols on the leftmost reel receiving a higher percentage than the progressive-game symbols on the rightmost reel.

21. The gaming-system control module of claim 11, wherein the gaming system includes a progressive-game controller for controlling aspects of the progressive game, each of the gaming terminals has a gaming-terminal controller, the at least one controller including the gaming-terminal controllers and the progressive-game controller.

22. The gaming-system control module of claim 11, wherein the updated values of some of the progressive-game symbols are different.

23. The gaming-system control module of claim 11, wherein the updated values of the progressive-game symbols are displayed while the reels are static or slowly moving such that the player can see the incrementing of the individual values that results in the updated values.

24. The gaming-system control module of claim 11, wherein the progressive game award is a non-monetary parameter.

25. The gaming-system control module of claim 24, wherein the non-monetary parameter is selected from the group consisting of a number of free spins and a number of player-selections from an array of player selectable elements.

26. A method of conducting a wagering game on a gaming terminal, the wagering game including a plurality of reels with symbols including progressive-game symbols, the plurality of reels defining a symbol array to be displayed to a player, the wagering game providing access to a progressive game having progressive awards indicated by the progressive-game symbols, the method comprising:

receiving, from at least one wager input device on the gaming terminal, wager inputs from a player playing the wagering game;

displaying within the symbol array, via the use of at least one display on the gaming terminal, the incrementing of individual values of the progressive-game symbols, the incrementing occurring in response to the game play activity of the wagering game;

determining, via the use of at least one controller, that the player has achieved a progressive game award while playing the wagering game; and awarding the progressive game award to the player, an overall value of the progressive game award based on the individual values of the progressive-game symbols that are displayed on the plurality of reels on the display and that triggered the progressive game award.

27. The method of claim 26, wherein, after the determining and the awarding, resetting, via the use of the at least one controller, the value of the progressive-game symbols that triggered the progressive game award to a base reset value and maintaining other ones of the progressive-game symbols at their existing values.

28. The method of claim 26, wherein the individual values of the progressive-game symbols are different.

29. The method of claim 26, wherein the gaming terminal is part of a gaming system that includes a plurality of gaming terminals and a progressive-game controller for controlling aspects of the progressive game, each of the gaming terminals has a gaming-terminal controller, the at least one controller including the gaming-terminal controller for the gaming terminal and the progressive-game controller.

30. The method of claim 26, wherein the individual values of the progressive-game symbols that triggered the progressive game award are summed to result in the progressive game award.

31. The method of claim 26, wherein the progressive game award is a non-monetary parameter.

32. The method of claim 31, wherein the non-monetary parameter is selected from the group consisting of a number of free spins and a number of player-selections from an array of player selectable elements.

33. The method of claim 26, wherein the game play activity that causes the incrementing is the receipt of the wager inputs.

34. The method of claim 26, wherein the game play activity that causes the incrementing is the display of certain symbols or symbol combinations.

35. A gaming terminal for playing a wagering game having a plurality of reels with symbols including progressive-game symbols, the wagering game providing access to a progressive game having progressive game awards that are indicated by the progressive-game symbols, the gaming terminal comprising:

a wager input device for receiving a wager input for playing the wagering game;

a display for displaying the plurality of reels with the progressive-game symbols, the plurality of reels defining a symbol array, each of the progressive-game symbols being displayed with an associated individual value within the symbol array; and at least one controller coupled to the display and operative to:

cause the display to display the incrementing of the individual values of the progressive-game symbols based on game play activity;

provide a progressive game award based on the individual values of the progressive-game symbols on the plurality of reels that triggered the progressive game award.

36. The gaming terminal of claim 35, wherein the individual values of the progressive-game symbols that triggered the progressive game award are summed to result in the progressive game award.

37. The gaming terminal of claim 35, wherein the incrementing is displayed while the reels are static or slowly moving such that the player can see the incrementing of the individual values.

38. The gaming terminal of claim 35, wherein the gaming terminal is a part of a gaming system connected to a plurality of other gaming terminals, the controller is operative to cause the display to display the incrementing of the individual values of the progressive-game symbols based on game play activity at the plurality of other gaming terminals.

39. The gaming terminal of claim 35, wherein the game play activity that causes the incrementing is the receipt of the wager inputs.

40. The gaming terminal of claim 35, wherein the game play activity that causes the incrementing is the display of certain symbols or symbol combinations.

41. The gaming terminal of claim 35, wherein the progressive game award is a non-monetary parameter.

42. The gaming terminal of claim 41, wherein the non-monetary parameter is selected from the group consisting of a number of free spins and a number of player-selections from an array of player selectable elements.

43. The gaming terminal of claim 35, wherein the at least one controller is further operative to cause one of the progressive symbols to form a clump of progressive symbols at more than one symbol location of the reel.

44. The gaming terminal of claim 43, wherein the clump of progressive symbols is formed in response to the individual value of the progressive game symbol incrementing above a predetermined value.

45. A method of conducting a wagering game on a gaming system, the wagering game including a base game and a progressive game having progressive game awards that are indicated by progressive-game symbols, the method comprising:

receiving, from a wager-input-device, a wager input from a player playing the wagering game;

allocating, by use of at least one controller, a portion of the wager input to the progressive game, the allocated portion being assigned to the progressive-game symbols;

presenting, on at least one display, the base game with a plurality of moveable reels having symbols thereon, the symbols including the progressive-game symbols, each of the progressive-game symbols having a displayed individual value that is associated therewith, each of the displayed individual values moving with the associated progressive-game symbol across the at least one display;

in response to a first triggering condition, awarding a first progressive game award to the player, the first progressive game award based on the displayed individual values of a first group of progressive-game symbols being displayed on the plurality of moveable reels, and in response to a second triggering condition, awarding a second progressive game award to the player, the second progressive game award based on the displayed individual values of a second group of progressive-game symbols being displayed on the plurality of moveable reels, the first progressive game award being different from the second progressive game award.

46. A control module for a gaming system including a plurality of gaming terminals for playing wagering games having a plurality of moveable reels, the wagering games provide access to a progressive game having multiple progressive game awards that are indicated by progressive-game symbols, each of the progressive-game symbols has a base reset value and an individual value that increases from the base reset value in response to wager inputs at the plurality of gaming terminals, each of the gaming terminals including a display for displaying the plurality of reels, the gaming-system control module comprising:

at least one controller configured to:

allocate a portion of a wager input received from a first player at a first gaming terminal to the progressive-game symbols, each of the progressive-game symbols receiving a percentage of the allocated portion of the wager input;

determine an updated value of each of progressive-game symbols based on the allocated portion of the wager input received from the first player; and instruct each of the plurality of gaming terminals to display, on their respective displays, the updated values of the progressive-game symbols on the plurality of reels during the wagering game, a first displayed updated value for a first progressive-game symbol being different from a second displayed updated value for a second progressive-game symbol, the first progressive-game symbol and the second progressive-game symbol being the same type of symbol.

* * * * *